US010358757B2

(12) United States Patent
Lee et al.

(10) Patent No.: US 10,358,757 B2
(45) Date of Patent: Jul. 23, 2019

(54) WASHING MACHINE AND METHOD OF CONTROLLING THE WASHING MACHINE

(71) Applicant: Samsung Electronics Co., Ltd., Suwon-si (KR)

(72) Inventors: Seung-Mok Lee, Suwon-si (KR); Sang Tak Lee, Hwaseong-si (KR); Yong Soo Kyong, Seoul (KR); Ju-Yeong Kim, Uiwang-si (KR); Young Jin Um, Suwon-si (KR); Jea Won Lee, Hwaseong-si (KR); Jee-Hoon Lee, Suwon-si (KR); Kab Jin Jun, Gwangju-si (KR); Jun Won Seo, Hwaseong-si (KR); Sung-Chul Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 316 days.

(21) Appl. No.: 14/831,217

(22) Filed: Aug. 20, 2015

(65) Prior Publication Data

US 2016/0053423 A1 Feb. 25, 2016

(30) Foreign Application Priority Data

Aug. 22, 2014 (KR) ..... 10-2014-0109612

(51) Int. Cl.
*D06F 37/00* (2006.01)
*D06F 37/10* (2006.01)
(Continued)

(52) U.S. Cl.
CPC ..... *D06F 37/10* (2013.01); *D06F 37/26* (2013.01); *D06F 37/28* (2013.01); *D06F 39/12* (2013.01); *D06F 39/14* (2013.01)

(58) Field of Classification Search
CPC ..... D06F 39/14; D06F 25/00; D06F 58/04; D06F 37/266; D06F 39/12
(Continued)

(56) References Cited

U.S. PATENT DOCUMENTS 1,447,420 A * 3/1923 Kirby ..... D06F 23/02 68/25
2,296,257 A * 9/1942 Breckenridge ..... D06F 23/02 248/604
(Continued)

FOREIGN PATENT DOCUMENTS

GB 540957 A * 11/1941 ..... D06F 13/02
GB 540957 A 11/1941
(Continued)

OTHER PUBLICATIONS

Tani, Kazutoshi; "Washing Machine" Mar. 1995, JP-07059983 Machine Translation.*
(Continued)

*Primary Examiner* — Michael E Barr
*Assistant Examiner* — Thomas Bucci
(74) *Attorney, Agent, or Firm* — Staas & Halsey LLP

(57) ABSTRACT

Disclosed herein are a washing machine including a moving mechanism and a method of controlling the washing machine. The washing machine includes a cabinet, a tub disposed inside the cabinet, a drum rotatably provided inside the tub, a front panel which is located at one side of the cabinet and comprises an opening through which laundry is inserted and taken out, and a driving unit which moves the tub to change a space between the tub and the front panel. It is possible to prevent oscillation from being transferred by spacing the front panel and the tub apart during washing. Also, it is possible to provide convenience for a user by
(Continued)

arranging the front panel and the tub adjacent to each other while inserting or taking out laundry.

20 Claims, 44 Drawing Sheets

(51) Int. Cl.
*D06F 37/26* (2006.01)
*D06F 37/28* (2006.01)
*D06F 39/12* (2006.01)
*D06F 39/14* (2006.01)

(58) Field of Classification Search
USPC ..... 68/142, 20, 24, 140, 23.1, 196, 139; 34/603, 596, 601, 595, 602, 242; 312/228, 222, 326, 329
See application file for complete search history.

(56) References Cited

U.S. PATENT DOCUMENTS 2,665,575 A * 1/1954 Cockerill ..... D06F 23/04 192/18 A
2,782,622 A * 2/1957 Candor ..... D06F 25/00 68/20
2,899,816 A * 8/1959 Jacobsen, Jr. ..... D06F 25/00 34/596
3,302,433 A * 2/1967 Nallinger ..... D06F 33/00 68/12.21
4,835,993 A * 6/1989 Dreher ..... D06F 95/00 68/142
5,074,131 A * 12/1991 Hirose ..... D06F 25/00 34/603
5,090,220 A * 2/1992 Fukuzawa ..... D06F 23/00 248/550
5,111,673 A * 5/1992 Kadoya ..... D06F 25/00 68/12.04
5,289,703 A * 3/1994 Hiyashi ..... D06F 37/04 68/142
5,327,603 A * 7/1994 Roh ..... D06F 13/02 68/131
5,442,937 A * 8/1995 Kwon ..... D06F 23/00 68/12.27
5,528,913 A * 6/1996 Savkar ..... D06F 37/20 248/610
5,613,380 A * 3/1997 Savkar ..... D06F 37/20 248/610
6,151,930 A * 11/2000 Carlson ..... D06F 37/20 68/12.06
6,260,391 B1 * 7/2001 Rippe ..... D06F 95/00 34/236
6,286,344 B1 * 9/2001 Jeon ..... D06F 23/06 68/173
6,516,484 B2 * 2/2003 Kwon ..... D06F 21/10 68/12.12
6,530,245 B1 * 3/2003 Kawabata ..... D06F 25/00 68/140
6,539,753 B1 * 4/2003 Ito ..... D06F 23/06 68/140
6,557,383 B1 * 5/2003 Ito ..... D06F 37/04 68/140
6,584,814 B2 * 7/2003 Son ..... D06F 23/06 68/24
6,615,619 B2 * 9/2003 Kakuda ..... D06F 23/06 68/140
6,761,049 B2 * 7/2004 Nitschmann ..... D06F 37/266 34/242
6,971,189 B1 * 12/2005 Anibas ..... D06F 58/04 34/602
7,404,305 B2 * 7/2008 Kim ..... D06F 39/14 34/603
7,614,162 B2 * 11/2009 Renzo ..... D06F 37/28 34/595
7,849,716 B2 * 12/2010 Lim ..... D06F 37/266 68/12.01
7,942,025 B1 * 5/2011 Musone ..... D06F 25/00 34/603
7,958,756 B2 * 6/2011 Gracia Bobed ..... D06F 37/266 68/139
8,127,464 B2 * 3/2012 Schone ..... D06F 39/14 312/228
8,166,782 B2 * 5/2012 Lim ..... D06F 37/267 68/20
8,616,027 B2 * 12/2013 Chang ..... D06F 37/206 68/23.1
8,671,718 B2 * 3/2014 Lim ..... D06F 37/22 68/12.06
8,701,448 B2 * 4/2014 Jang ..... D06F 37/266 68/139
8,826,701 B2 * 9/2014 Hong ..... D06F 33/02 68/140
8,997,533 B2 * 4/2015 Kim ..... D06F 37/00 68/140
2003/0019254 A1 * 1/2003 Shaw ..... D06F 95/00 68/142
2003/0115915 A1 * 6/2003 Nitschmann ..... D06F 37/266 68/139
2003/0172689 A1 * 9/2003 Fitton ..... D06F 37/266 68/12.26
2004/0016266 A1 * 1/2004 Hisano ..... D06F 37/20 68/23.1
2004/0089031 A1 * 5/2004 Kim ..... D06F 37/28 68/196
2004/0148980 A1 * 8/2004 Kim ..... D06F 37/20 68/23 R
2004/0159009 A1 * 8/2004 Hwang ..... D06F 58/04 34/601
2004/0163426 A1 * 8/2004 Kim ..... D06F 37/266 68/23 A
2004/0244121 A1 * 12/2004 Lim ..... D06F 23/06 8/159
2004/0244435 A1 * 12/2004 Kim ..... D06F 39/14 68/12.26
2004/0244436 A1 * 12/2004 Park ..... D06F 37/20 68/12.26
2004/0244438 A1 * 12/2004 North ..... D06F 25/00 68/23.2
2005/0126231 A1 * 6/2005 Brinkmann ..... D06F 37/262 68/24
2005/0178169 A1 * 8/2005 Kim ..... D06F 37/266 68/23.1
2006/0016228 A1 * 1/2006 Chang ..... D06F 37/22 68/23.1
2006/0037213 A1 * 2/2006 Kajihara ..... D06F 25/00 34/596
2006/0169006 A1 * 8/2006 Lim ..... D06F 37/267 68/13 R
2006/0265899 A1 * 11/2006 Renzo ..... D06F 58/04 34/603
2007/0051012 A1 * 3/2007 Schoene ..... D06F 37/28 34/603
2007/0056327 A1 * 3/2007 Oh ..... D06F 37/04 68/3 R
2007/0137260 A1 * 6/2007 Shikamori ..... D06F 17/06 68/3 R
2007/0137265 A1 * 6/2007 Shikamori ..... D06F 39/10 68/208
2007/0227200 A1 * 10/2007 Kim ..... D06F 37/22 68/140
2008/0178638 A1 * 7/2008 Tanaka ..... D06F 35/001 68/212
2011/0041563 A1 * 2/2011 Kim ..... D06F 37/20 68/23.1
2011/0113568 A1 * 5/2011 Han ..... D06F 39/003 8/137
2011/0285260 A1 * 11/2011 Moon ..... D06F 25/00 312/228
2012/0042697 A1 * 2/2012 Hong ..... D06F 33/02 68/12.23

(56) References Cited

U.S. PATENT DOCUMENTS

| | | | | |
|---|---|---|---|---|
| 2012/0042699 | A1* | 2/2012 | Kwon | D06F 37/22 68/140 |
| 2012/0151685 | A1* | 6/2012 | Jang | D06F 35/007 8/137 |
| 2012/0151688 | A1* | 6/2012 | Jang | D06F 37/203 8/137 |
| 2012/0167639 | A1* | 7/2012 | Kikukawa | D06F 23/025 68/141 |
| 2012/0186305 | A1* | 7/2012 | Taniguchi | D06F 25/00 68/19 |
| 2013/0036774 | A1* | 2/2013 | Kim | D06F 37/26 68/142 |
| 2013/0042492 | A1* | 2/2013 | Nishimura | D06F 33/02 34/108 |
| 2013/0076220 | A1* | 3/2013 | Yeom | D06F 39/14 312/326 |
| 2013/0152641 | A1* | 6/2013 | Carrillo | D06F 37/266 68/12.26 |
| 2015/0122967 | A1* | 5/2015 | Kim | D06F 37/302 248/550 |

FOREIGN PATENT DOCUMENTS

| | | | | |
|---|---|---|---|---|
| GB | 1053878 | A | 1/1967 | |
| JP | 07059983 | * | 3/1995 | D06F 37/12 |
| JP | H0759983 | A | 3/1995 | |
| JP | 2009061105 | A * | 3/2009 | |
| KR | 10-0484839 | B1 | 6/2004 | |

OTHER PUBLICATIONS

Sano, Shogo; "Drum Type Washing Machine"; Mar. 2009; JP-2009061105—Machine Translation (Year: 2009).*

Office Action dated Apr. 25, 2017 corresponding to Chinese Patent Application No. 201510776507.0.

Communication with European Search Report dated Mar. 18, 2016 corresponding to European Patent Application No. 15181893.7.

Decision on Grant dated Dec. 4, 2017 corresponding to Chinese Patent Application No. 201510776507.0.

Examination Communication dated Apr. 5, 2018 corresponding to European Patent Application No. 15181893.7.

European Search Report, Communication pursuant to Article 94(3) EPC, issued in European Application No. 15181893.7 dated Aug. 9, 2018 (5 pages).

European Patent Office issued Communication under Rule 71(3)EPC in European Patent Application No. 15181893.7 dated Feb. 1, 2019 (5 pages total).

* cited by examiner

WASHING MACHINE AND METHOD OF CONTROLLING THE WASHING MACHINE

CROSS-REFERENCE TO RELATED APPLICATION

This application claims the benefit of Korean Patent Application No. 2014-0109612, filed on Aug. 22, 2014 in the Korean Intellectual Property Office, the disclosure of which is incorporated herein by reference.

BACKGROUND

Embodiments of the present disclosure relate to a washing machine and a method of controlling the washing machine, and more particularly, to a washing machine including a moving mechanism and a method of controlling the washing machine.

Washing machines are apparatuses for removing dirt on the laundry employing the action of a detergent and water. Washing machines may be classified depending on a washing method into agitator-type washing machines, pulsator-type washing machines, and drum-type washing machines. In the case of agitator-type washing machines, washing is performed by rotating a washing rod rising in the center of a washing tub left and right. In the case of pulsator-type washing machines, washing is performed using a frictional force between a water current and laundry generated by rotating a pulsator left and right, which has a circular plate shape and formed on a bottom of a washing tub. In the case of drum-type washing machines, washing is performed by inserting water, a detergent, and laundry into a drum having a plurality of lifters protruding from an inner surface thereof and rotating the drum.

Washing machines may be classified depending on a configuration for loading laundry into top-loading washing machines and front-loading washing machines. In the case of top-loading washing machines, it is possible to insert laundry into a washing tub through an opening provided on a top surface thereof. In the case of front-loading washing machines, it is possible to insert laundry into a washing tub through an opening provided on a side surface thereof. Generally, agitator-type washing machines and pulsator-type washing machines are provided as top-loading washing machines, and drum-type washing machines are provided as front-loading washing machines.

Drum-type washing machines each may include a cabinet which forms an exterior of a washing machine, a tub which stores washing water inside the cabinet, and a drum which is rotatably installed inside the tub. An opening is formed in front of the cabinet to insert or take laundry into, or out of, the cabinet, and may be open and closed by a door coupled with a front of the cabinet.

Generally, a diaphragm which absorbs oscillation of the tub and seals a gap between the tub and the cabinet is installed between the tub and cabinet. However, mold or the like may be generated due to residual washing water or foreign substances flowing into the diaphragm.

Also, when the diaphragm is removed, a certain space is formed between the tub and the cabinet, and laundry may fall into the space while being insert thereinto or taken out thereof. Also, there is a risk of water leakage and the washing machine does not look nice. When the tub is brought in contact with the cabinet to remove the space between the tub and the cabinet, the oscillation of the tub may be transferred to the cabinet.

SUMMARY

Therefore, it is an aspect of the present disclosure to provide a washing machine in which a space between a tub and a front panel is changeable according to an operation of the washing machine.

It is another aspect of the present disclosure to provide a washing machine in which an inner door provided at one side of a tub is selectively coupled with one of the tub and an outer door.

Additional aspects of the disclosure will be set forth in the description below that will be apparent to one of ordinary skill of art, or may be learned by practice of the invention.

In accordance with one aspect of the present disclosure, a washing machine includes a cabinet, a tub disposed inside the cabinet, a drum rotatably provided inside the tub, a front panel which is located at one side of the cabinet and comprises an opening through which laundry is inserted and taken out, and a driving unit which moves the tub to change a space between the tub and the front panel.

The driving unit may be installed in the cabinet to move the tub. When the laundry is inserted into or taken out of the drum, the driving unit may arrange the front panel and the tub to be in contact with each other. When the drum rotates, the driving unit may arrange the front panel and the tub to be separated from each other.

The washing machine may further include an outer door provided at the front panel to open and close the opening and an inner door provided at the tub to prevent a water leakage of the tub. The inner door may be provided to be attachable to and detachable from at the outer door. The inner door may be coupled with the outer door when the laundry is inserted into or taken out of the drum, and the inner door may be coupled with the tub when the drum rotates.

At least one of the inner door and the outer door may include a first coupling member to couple the inner door with the outer door. At least one of the inner door and the tub may include a second coupling member to couple the inner door with the tub. The first coupling member and the second coupling member may be disposed to be interlocked with each other. The inner door may be selectively coupled with one of the tub and the outer door.

The driving unit may move the tub in at least one of front, rear, upper, and lower directions. The driving unit may move the tub to a front, upper portion of the cabinet to reduce the space between the tub and the front panel. The driving unit may move the tub to a rear, lower portion of the cabinet to increase the space between the tub and the front panel. The driving unit may include a fixed portion fixed to one side of the cabinet and a moving portion movably provided at the fixed portion.

The moving portion may include a moving contact surface in contact with the tub. The moving contact surface may be formed as an inclined plane. The tub may include a tub contact surface formed as an inclined plane to correspond to the moving contact surface, and the tub contact surface and the moving contact surface may be in contact with each other and may move the tub. The driving unit may be installed to connect the tub with the cabinet, and a length of the driving unit may be changeable.

In accordance with another aspect of the present disclosure, a washing machine includes a cabinet, an outer door provided at one side of the cabinet, a tub disposed inside the cabinet to be movable forward and rearward, and an inner door provided at one side of the tub and detachably coupled with the outer door. The inner door may be selectively coupled with one of the outer door and the tub.

The washing machine may further include a first coupling member provided to couple the inner door with the outer door and a second coupling member provided to couple the inner door with the tub. The washing machine may further include a driving unit which moves at least one of the inner door and the outer door. The outer door may be pivotably installed at the one side of the cabinet, and the inner door and the outer door may be coupled with each other to be pivotable together.

In accordance with still another aspect of the present disclosure, a method of controlling a washing machine which comprises a cabinet having a front panel provided at one side thereof and a tub disposed therein includes moving one of the tub and the front panel to increase a space between the tub and the front panel, rotating a drum disposed inside the tub to wash laundry, and moving one of the tub and the front panel to reduce the space between the tub and the front panel. The method may include coupling an outer door provided at one side of the front panel with an inner door provided at one side of the tub when the space between the tub and the front panel is reduced. The method may include spacing the outer door and the inner door apart when the space between the tub and the front panel increases. The method may include releasing the coupling between the outer door and the inner door and coupling the inner door with the tub.

A first coupling member which couples the outer door with the inner door and a second coupling member which couples the tub with the inner door may be disposed to be interlocked with each other. The inner door may be coupled with the outer door to pivot together when the laundry is inserted into or taken out of the drum.

An inner door provided at one side of the tub may be selectively coupled with one of an outer door provided at one side of the front panel and the tub. At least one of the front panel and the tub may be moved by the driving unit. The tub may be moved inside the cabinet and attachable to and detachable from the front panel.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
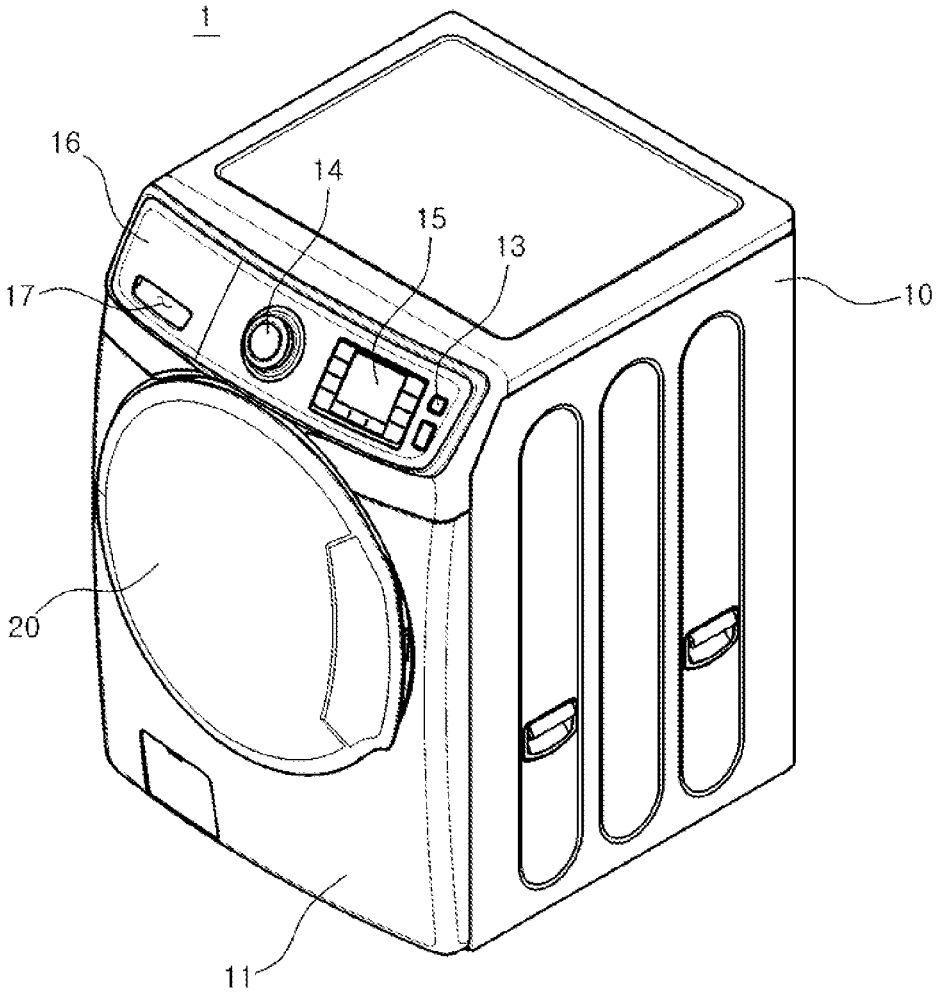
FIG. 1 is a view of a washing machine according to one embodiment of the present disclosure.

Reference will now be made in detail to the embodiments of the present disclosure, examples of which are illustrated in the accompanying drawings, wherein like reference numerals refer to like elements throughout. Hereinafter, embodiments of the present disclosure will be described in detail with reference to the attached drawings.

Figure 2:
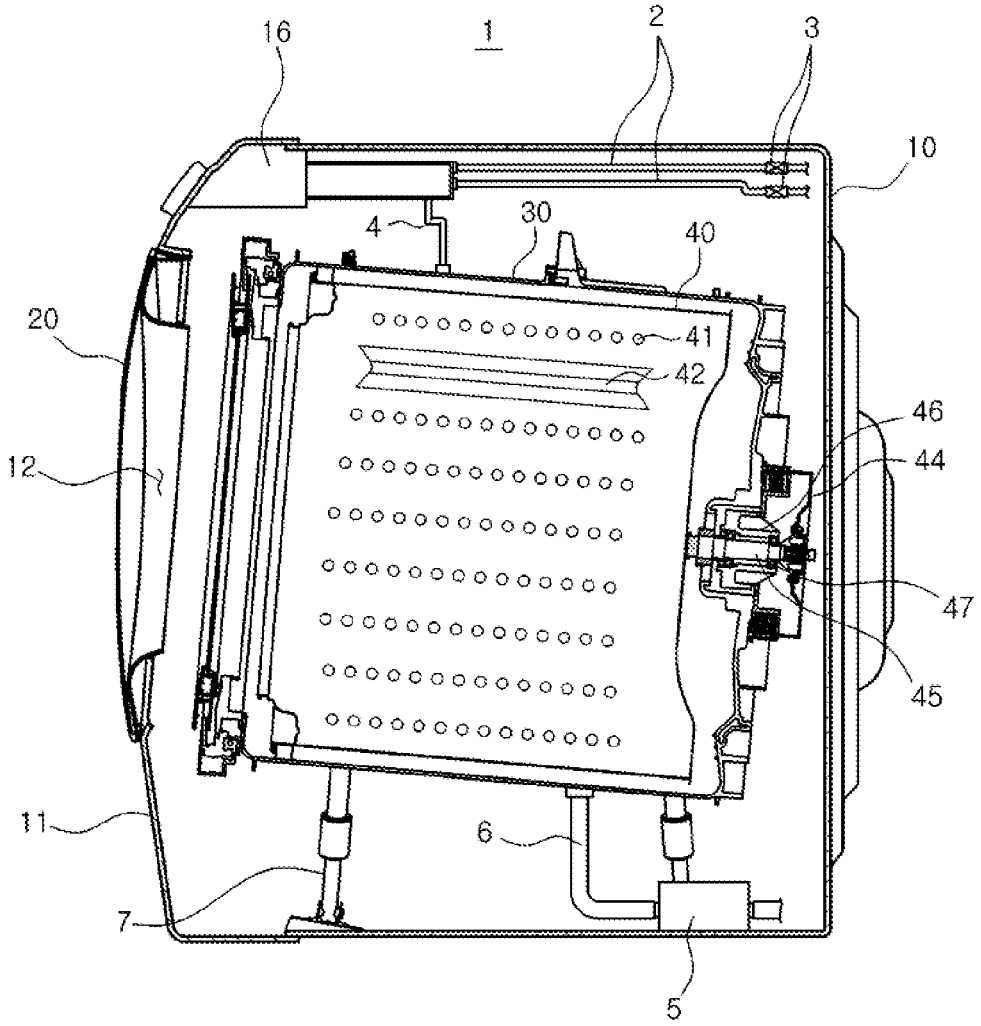
FIG. 2 is a side cross-sectional view of the washing machine in a washing mode according to one embodiment of the present disclosure.

FIG. 1 is a view of a washing machine 1 according to one embodiment of the present disclosure. FIG. 2 is a side cross-sectional view of the washing machine 1 in a washing mode according to one embodiment of the present disclosure. FIG. 2 illustrates components of the washing machine 1.

As shown in FIG. 1, the washing machine 1 may include a cabinet 10 and the cabinet 10 may form an exterior of the washing machine 1. Also, the washing machine 1 may include a front panel 11 located on one side of the cabinet 10. The front panel 11 may be located in front of the cabinet 10 and may form a front exterior of the washing machine 1.

The front panel 11 may include an opening 12 through which laundry is inserted and taken out and an outer door 20 which opens and closes the opening 12. The outer door 20 may be pivotably installed at the front panel 11 to open and close the opening 12. The outer door 20 will be described further.

Also, the front panel 11 may include a power button 13, an operation unit 14, and a display unit 15. The power button 13 may be provided to allow a user to turn on/off the power of the washing machine 1. The operation unit 14 may be provided in various forms to allow the user to select various modes of the washing machine 1. The display unit 15 may display operations selected by the power button 13 and the operation unit 14 to be recognized by the user.

Also, the front panel 11 may include a detergent box 16 into which the user may insert a detergent. In front of the detergent box 16, a detergent box grip portion 17 may be provided to allow the user to easily move the detergent box 16.

Referring to FIG. 2, the washing machine 1 may include a tub 30 located inside the cabinet 10. The tub 30 may be installed to store washing water.

Also, a drum 40 may be rotatably disposed inside the tub 30. The drum 40 may be provided to allow laundry to be loaded and washed therein. The drum 40 may include a plurality of through holes 41 provided to distribute the washing water. Also, on an inner circumferential surface of the drum 40, a plurality of laundry lifters 42 may be installed to lift and drop the laundry while the drum 40 is rotating.

Above the tub 30, water supply pipes 2 for supplying the washing water to the tub 30 are installed. One side of each of the water supply pipes 2 may be connected to an external water source (not shown) and the other side thereof may be connected to the detergent box 16. A water supply valve 3 which controls water supply may be installed at the water supply pipe 2.

The detergent box 16 may be connected to the tub 30 through a connection pipe 4. Accordingly, water supplied through the water supply pipe 2 is supplied into the tub 30 through the detergent box 16 together with the detergent along the connection pipe 4.

Below the tub 30, a drainage pump 5 and a drain 6 are installed to discharge the water inside the tub 30 to the outside of the cabinet 10. Also, below the tub 30, a damping member 7 which elastically support the tub 30 may be provided. The damping member 7 may be installed to connect an inner, lower surface of the cabinet 10 with an outer surface of the tub 30. Also, the damping member 7 may be installed above the tub 30 to connect an inner, upper surface of the cabinet 10 with the outer surface of the tub 30.

On a rear surface of the tub 30, a motor 44 for rotating the drum 40 may be installed. The motor 44 may be mounted on the drum 40, and a driving shaft 45 of the motor 44 may be connected with the drum 40. When the motor 44 drives the driving shaft 45, the drum 40 connected with the driving shaft 45 may rotate about the driving shaft 45.

On the rear surface of the tub 30, a bearing housing 46 is installed to rotatably support the driving shaft 45. The bearing housing 46 may be formed of an aluminum alloy and may be inserted into a rear wall of the tub 30 when the tub 30 is injection-molded. Between the bearing housing 46 and the driving shaft 45, bearings 47 may be installed to allow the driving shaft 45 to smoothly rotate.

In a washing cycle, the motor 44 rotates the drum 40 in a first direction and second direction (e.g., opposite of the first direction) at a low speed in such a way that the laundry inside the drum 40 is repetitively lifted and dropped to remove dirt from the laundry. In a spin-drying cycle, when the motor 44 rotates the drum 40 in one direction at a high speed, water is separated from the laundry due to a centrifugal force applied to the laundry.

Hereinafter, a case in which the drum 40 is rotated by the motor 44, for example, the washing cycle and spin-drying cycle will be referred to as a washing mode. Also, a case in which the user inserts or takes the laundry into or out of the drum 40 will be referred to as a non-washing mode.

Figure 3:
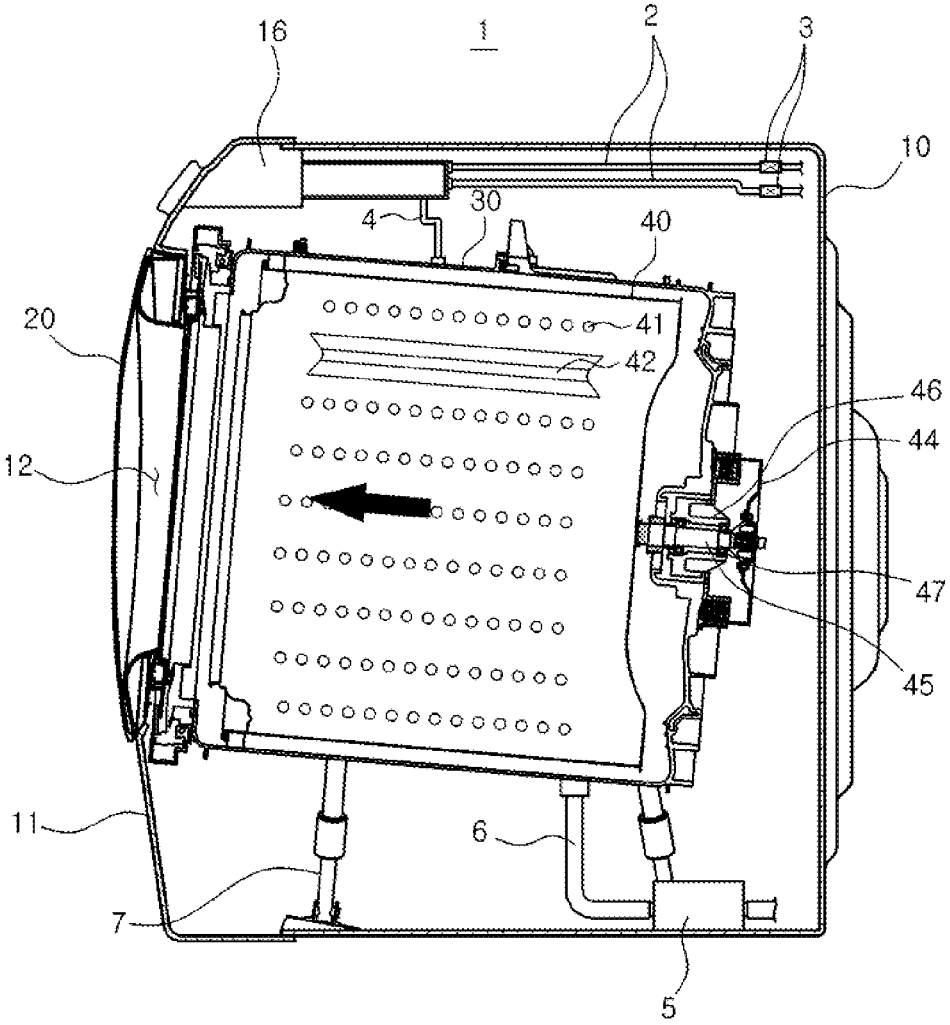
FIG. 3 is a side cross-sectional view of the washing machine in a non-washing mode according to one embodiment of the present disclosure.
Figure 4:
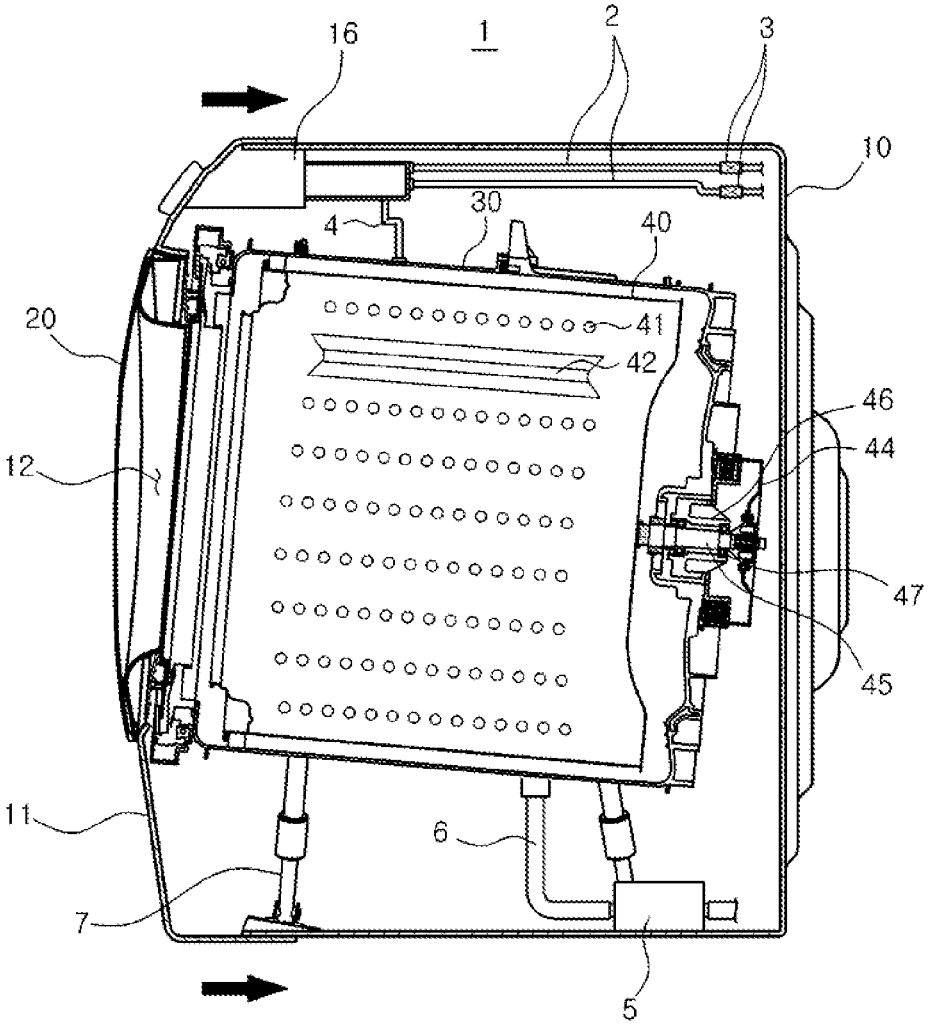
FIG. 4 is a side cross-sectional view of a washing machine in a non-washing mode according to another embodiment of the present disclosure.

FIG. 2 illustrates the washing mode. FIGS. 3 and 4 illustrate the non-washing mode. FIGS. 3 and 4 are views illustrating the movements of the tub 30 and the front panel 11 in FIG. 2, respectively.

Returning to FIG. 2, the front panel 11 and the tub 30 are arranged to have a space therebetween. That is, the tub 30 is supported by the damping member 7 inside the cabinet 10 and is disposed to be spaced from an inner surface of the cabinet 10. This is to prevent the oscillation of the tub 30 caused by the rotation of the drum 40 from being transferred to the cabinet 10.

However, in the non-washing mode, the laundry may fall into the space between the front panel 11 and the tub 30. Accordingly, to prevent it, in the non-washing mode, the front panel 11 and the tub 30 are arranged to be in contact with each other.

That is, the front panel 11 and the tub 30 are installed to allow the space therebetween to be changeable. At least one of the front panel 11 and the tub 30 spaced at a certain interval in the washing mode may move to reduce the space therebetween in the non-washing mode. Here, the tub 30 may move as shown in FIG. 3 (e.g, as illustrated by the arrows), or the front panel 11 may move as shown in FIG. 4 (e.g, as illustrated by the arrows). Also, the tub 30 and the front panel 11 may move at the same time.

For a moving mechanism described above, the washing machine 1 may include a driving unit 100 (refer to FIG. 5) installed to move at least one of the front panel 11 and the tub 30. In the washing mode, the driving unit 100 may move at least one of the front panel 11 and the tub 30 to increase the space between the front panel 11 and the tub 30. Also, in the non-washing mode, the driving unit 100 may move at least one of the front panel 11 and the tub 30 to reduce the space between the front panel 11 and the tub 30.

Hereinafter, a moving mechanism in which the driving unit 100 moves the tub 30 will be described in detail.

Figure 5:
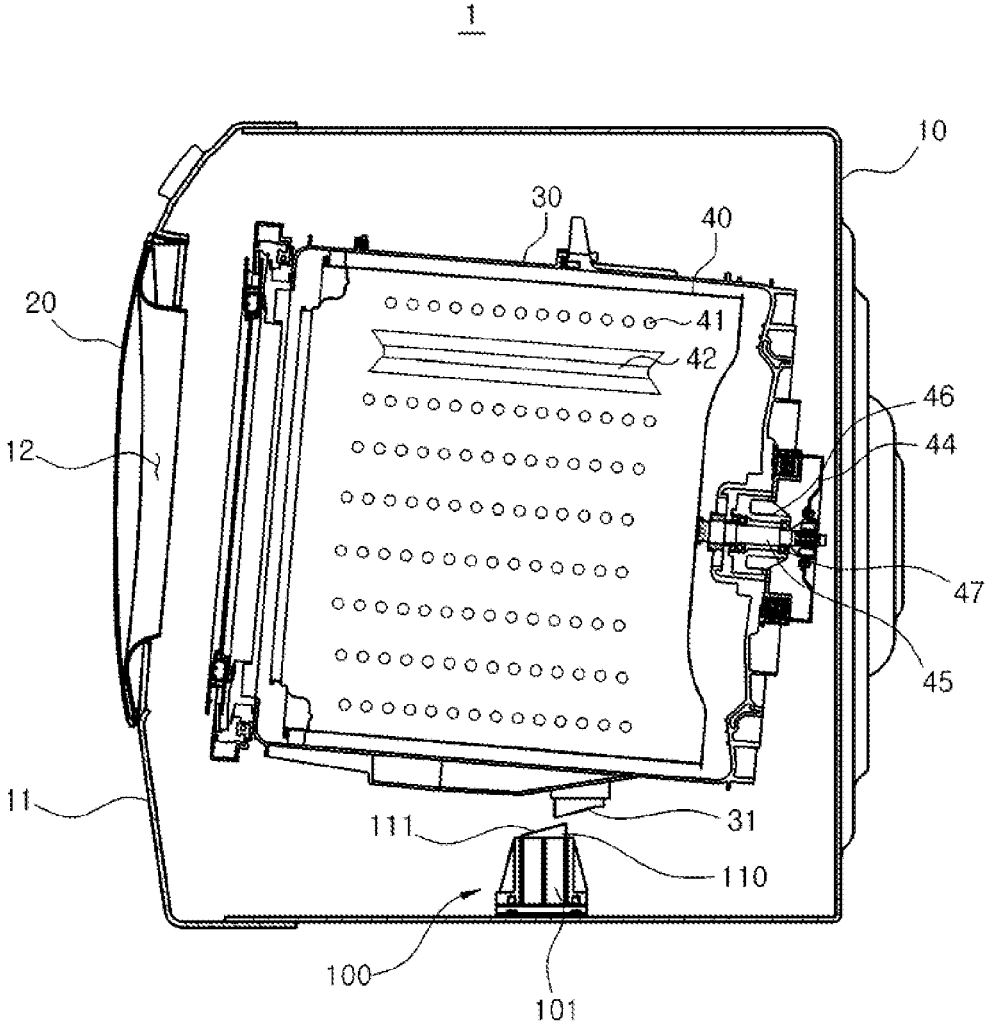
FIGS. 5 and 6 are side views of a driving unit and a tub of the washing machine according to one embodiment of the present disclosure.
Figure 6:
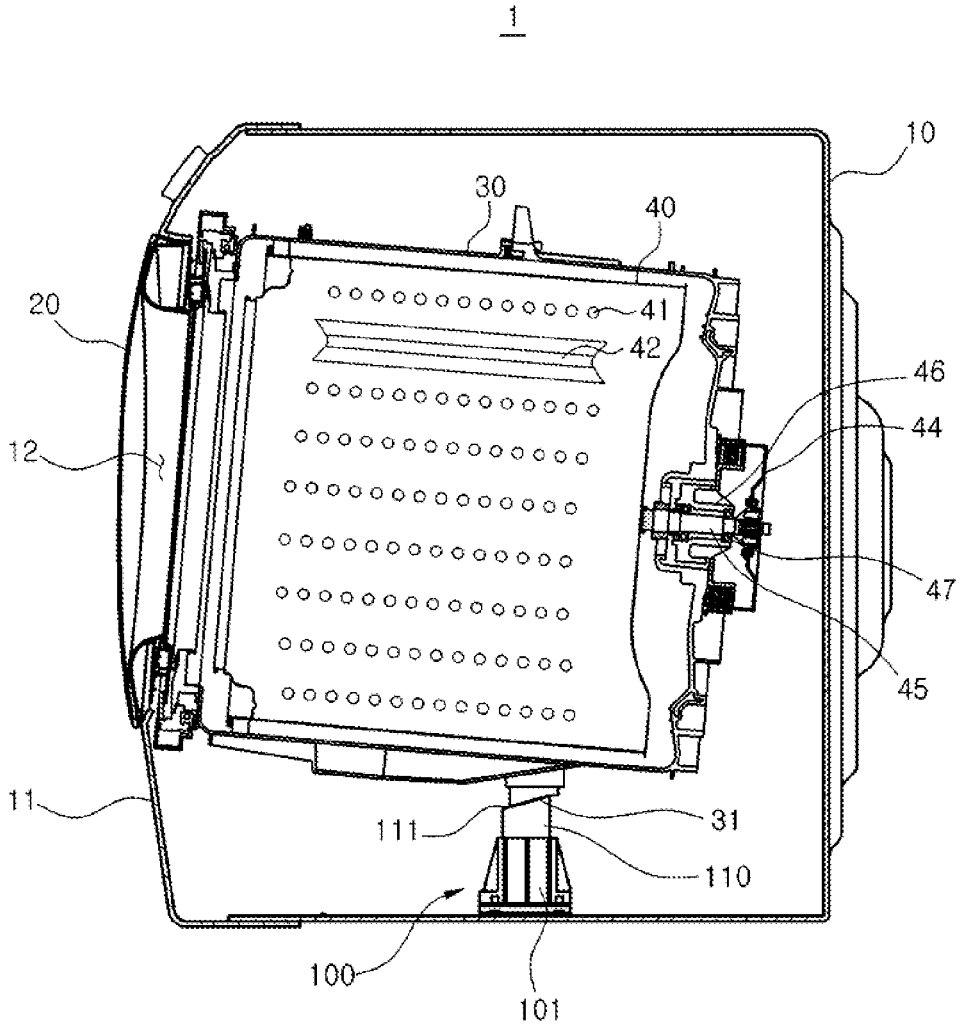

FIGS. 5 and 6 are side views of the driving unit 100 and the tub 30 of the washing machine 1 according to one embodiment of the present disclosure. To illustrate the movement of the tub 30 caused by the driving unit 100, unnecessary components for movement are omitted from FIGS. 5 and 5.

As shown in FIGS. 5 and 6, the tub 30 may be movably installed inside the cabinet 10. The washing machine 1 may include the driving unit 100 which provides a driving force to allow the tub 30 to move. The driving unit 100 may be disposed inside the cabinet 10.

The driving unit 100 may include a fixed portion 101 fixed to one side of the cabinet 10 and a moving portion 110 movably provided at the fixed portion 101. The fixed portion 101 may be mounted on the cabinet 10 and may stably support the moving portion 110. The moving portion 110 may move the tub 30 by applying an external force to the tub 30.

Also, the driving unit 100 may move the tub 30 in at least one of front, rear, upper, and lower directions. In detail, the driving unit 100 may move the tub 30 to a front upper portion of the cabinet 10 to reduce the space between the tub 30 and the front panel 11. Also, the driving unit 100 may move the tub 30 to a rear lower portion of the cabinet 10 to increase the space between the tub 30 and the front panel 11.

As shown in FIG. 5, without the external force caused by the driving unit 100, the tub 30 and the front panel 11 may be arranged at a certain interval. Here, the driving unit 100 applies the external force to the tub 30 in such a way that the tub 30 may move to the front upper portion of the cabinet 10.

Accordingly, as shown in FIG. 6, the tub 30 and the front panel 11 may be arranged adjacent to each other. Also, the tub 30 may move to the rear lower portion of the cabinet 10 by removing the external force of the driving unit 100 from the tub 30 in such a way that the tub 30 and the front panel 11 may be arranged again as shown in FIG. 5.

In the washing mode, the external force caused by the driving unit 100 is not applied and the tub 30 is disposed to have the certain interval from an inside of the cabinet 10 such as the front panel 11. Accordingly, it is possible to prevent the oscillation of the tub 30 from being transferred to the cabinet 10. In the non-washing mode, the external force caused by the driving unit 100 is applied to the tub 30 and the tub 30 is disposed adjacent to the front panel 11.

When the washing mode is switched into the non-washing mode, the tub 30 is moved forward to conveniently insert or take out the laundry. Also, the tub 30 is moved upward by the driving unit 100 to compensate for the sagging of the tub 30 caused by a load of the laundry. That is, the driving unit 100 may be disposed to provide a driving force for moving the tub 30 to the front upper portion of the cabinet 10.

Figure 7:
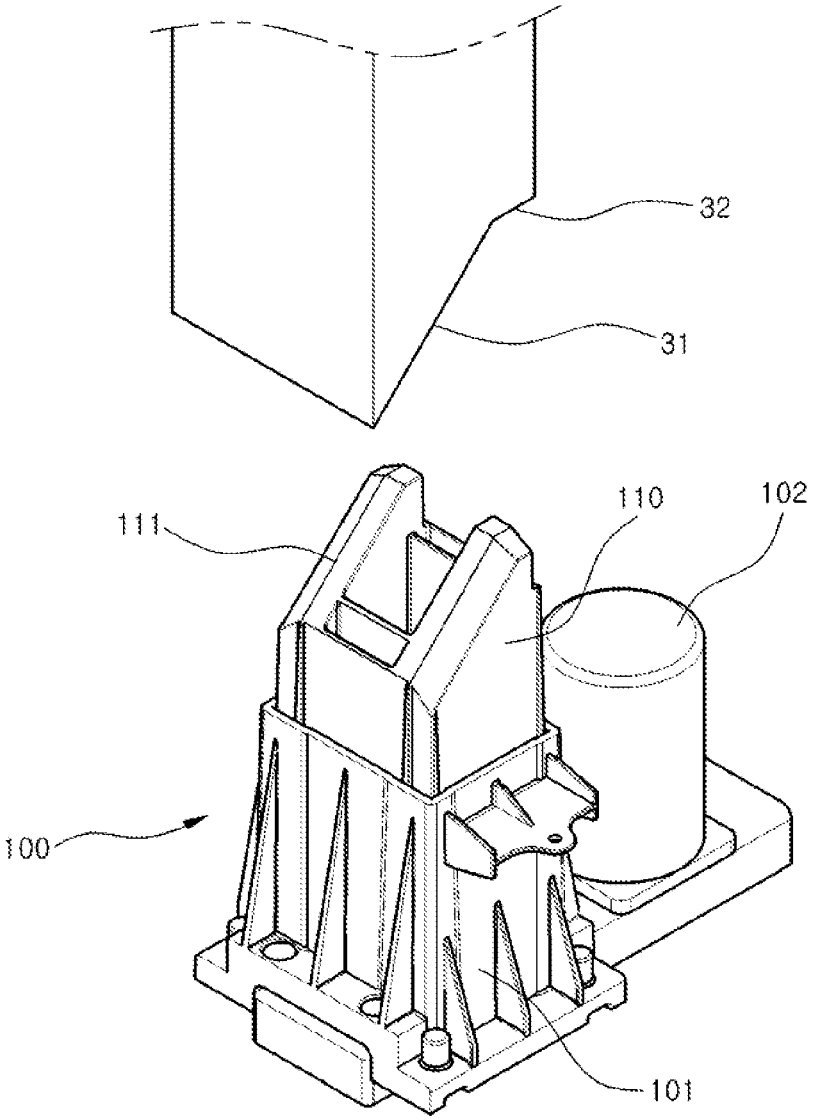
FIG. 7 is a view of the driving unit and a bottom of the tub of the washing machine according to one embodiment of the present disclosure.

FIG. 7 is a view of the driving unit 100 and a bottom surface of the tub 30 of the washing machine 1 according to one embodiment of the present disclosure.

As described above, the driving unit 100 may include the moving portion 110 which is in contact with the tub 30 and moves the tub 30. One surface of the moving portion 110 in contact with the tub 30 may be referred to as a moving contact surface 111. As shown in FIG. 7, the moving contact surface 111 may be formed as an inclined plane.

Also, the tub 30 may include a tub contact surface 31 in contact with the moving contact surface 111. The tub contact surface 31 may be formed as an inclined plane corresponding to the moving contact surface 111. The tub contact surface 31 may be integrated with the tub 30 or may be fixed to the tub 30 to be movable together. Accordingly, the tub 30 may move due to the external force applied to the tub contact surface 31.

The moving portion 110 may be installed to be vertically movable. As the moving portion 110 ascends, the moving contact surface 111 may be in contact with at least a part of the tub contact surface 31. While the moving portion 110 is continuously ascending, the tub contact surface 31 may move along the moving contact surface 111. As the tub contact surface 31 slides along the moving contact surface 111, the tub 30 may move toward a front of the cabinet 10.

A stopper portion 32 may be provided on one side of the tub contact surface 31. The stopper portion 32 may be installed to prevent the tub contact surface 31 from sliding along the moving contact surface 111. Accordingly, the tub contact surface 31 slides a certain distance along the moving contact surface 111 and one side of the moving contact surface 111 is in contact with the stopper portion 32, thereby preventing sliding. The moving portion 110 continuously ascends, and accordingly, the tub contact surface 31 may move toward an inner, upper surface of the cabinet 10.

Figure 8:
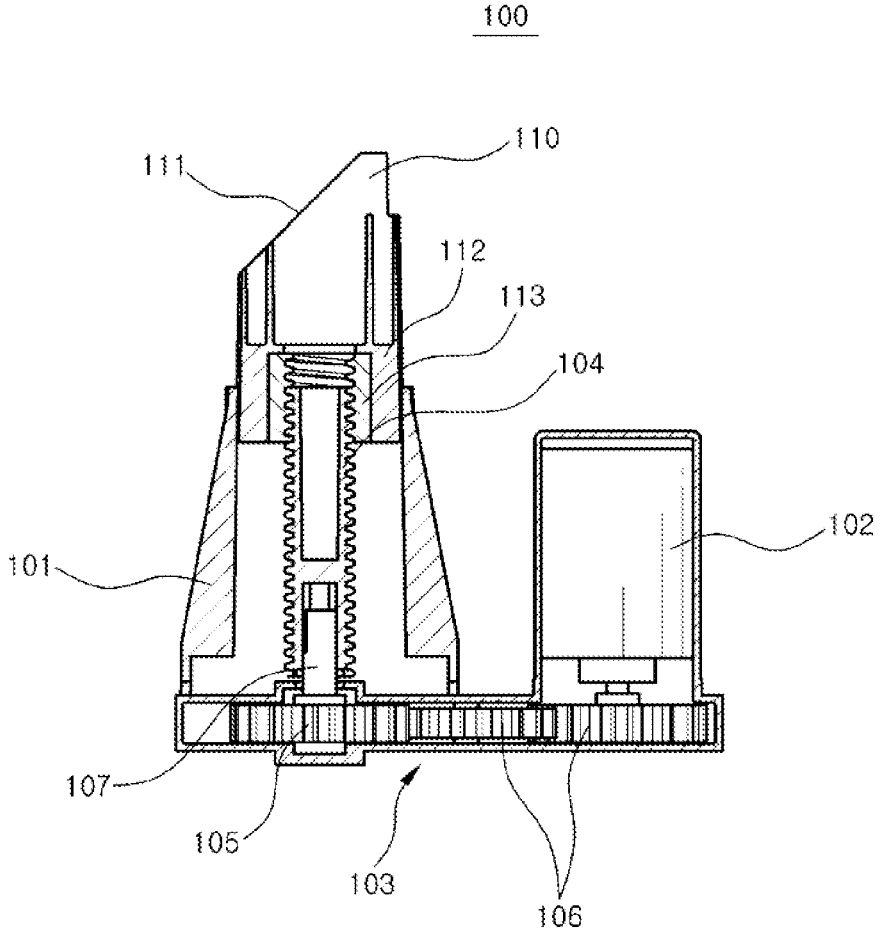
FIG. 8 is a view of the driving unit of the washing machine according to one embodiment of the present disclosure.

FIG. 8 is a view of the driving unit 100 of the washing machine 1 according to one embodiment of the present disclosure.

As described above, the driving unit 100 includes the fixed portion 101 and the moving portion 110. The moving portion 110 is installed to be vertically movable. Also, the driving unit 100 may include a driving motor 102 and a driving transfer member 103 which transmits a driving force of the driving motor 102 to the moving portion 110.

The fixed portion 101 may have an inner space in which the moving portion 110 and the driving transfer member 103 may be installed. The driving motor 102 may be installed on one side of the fixed portion 101 or may be installed inside the fixed portion 101. The fixed portion 101 may guide the moving portion 110 to vertically move. Also, a top of the fixed portion 101 may be provided to be open to allow the moving portion 110 to move therethrough.

The driving transfer member 103 may include a rotating screw 104, a shaft gear 105, and connecting gears 106 which connect the shaft gear 105 with the driving motor 102. The connecting gears 106 may be provided as various gears including a worm gear.

The shaft gear 105 may include a driving rotation shaft 107 which extends upward. The rotating screw 104 may be connected with the driving rotation shaft 107, and the rotating screw 104 may rotate due to the rotation of the driving rotation shaft 107.

One side of the rotating screw 104 may be mounted on the driving rotation shaft 107 and may rotate together. Accordingly, the driving motor 102 rotates and the connecting gears 106 transfer torque to the shaft gear 105. The rotating screw 104 may rotate due to the rotation of the shaft gear 105.

The moving portion 110 may include a moving lifter 112 including the moving contact surface 111 and a lifter screw 113 disposed inside the moving lifter 112. The rotating screw 104 may be disposed inside the lifter screw 113. The rotating screw 104 may be provided as a male screw, and the lifter screw 113 may be provided as a female screw corresponding to the rotating screw 104. Accordingly, as the rotating screw 104 rotates, the lifter screw 113 may move upward.

The moving lifter 112 and the lifter screw 113 may be integrated with each other or may be detachably coupled with each other. The moving lifter 112 and the lifter screw 113 may be installed to move together. Accordingly, as the rotating screw 104 rotates, the moving portion 110 may move upward.

Figure 9A:
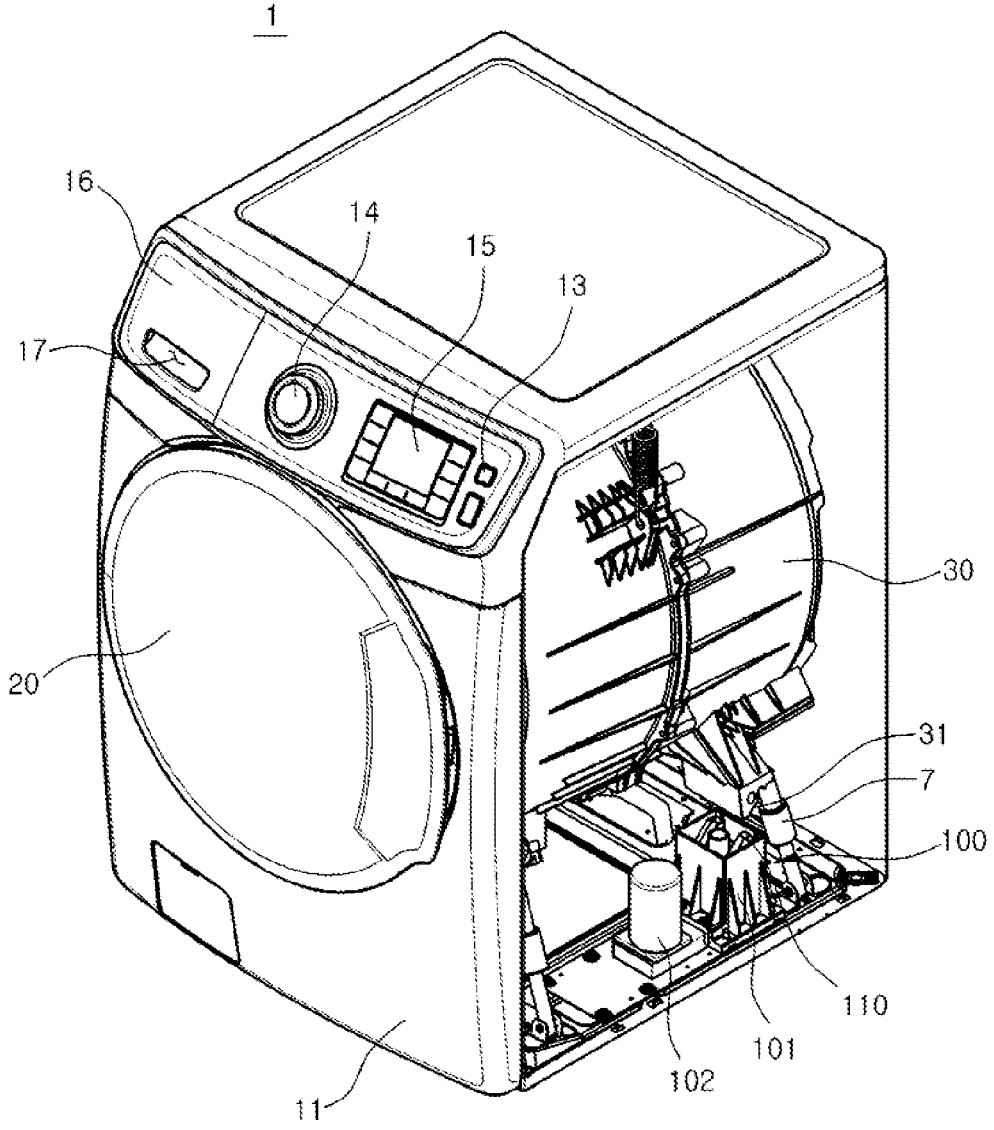
FIGS. 9A, 9B, and 9C are views illustrating an operation of the washing machine according to one embodiment of the present disclosure.
Figure 9B:
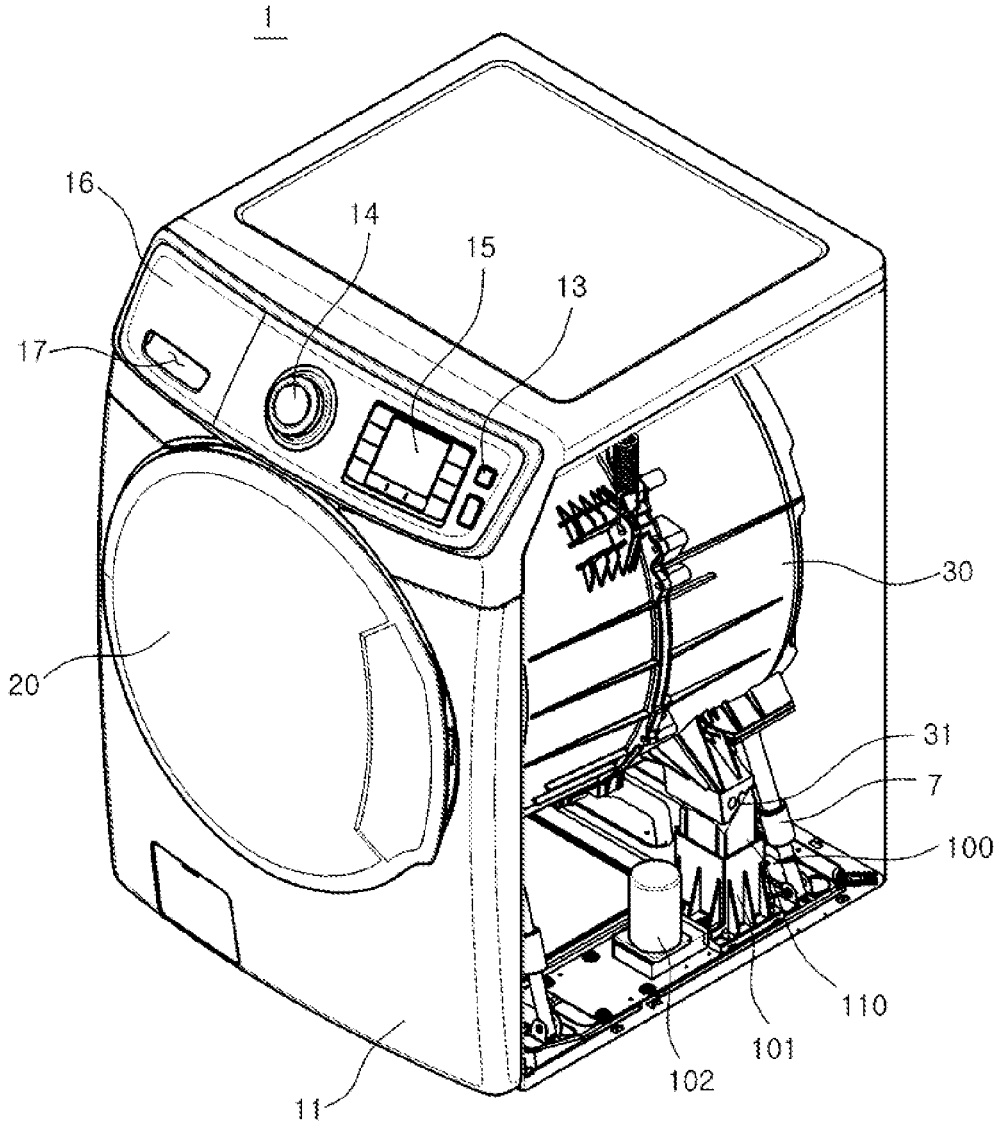
Figure 9C:
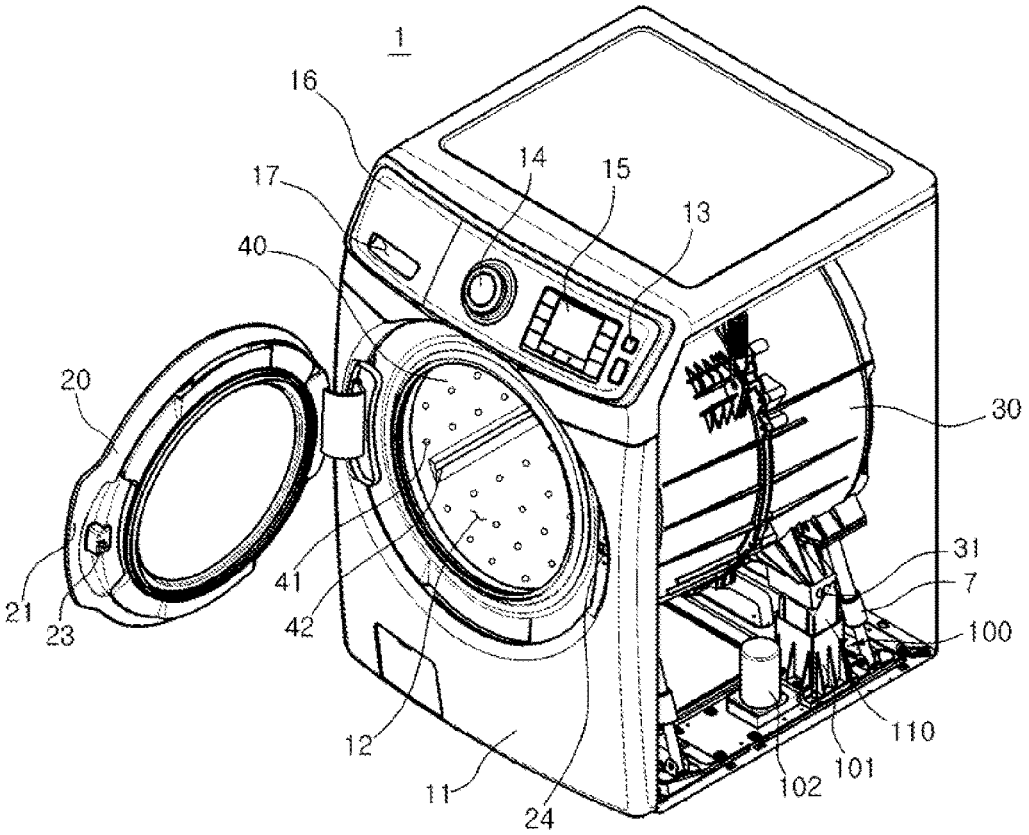

FIGS. 9A, 9B, and 9C are views illustrating an operation of the washing machine 1 according to one embodiment of the present disclosure. FIG. 9A illustrates the washing mode, and FIGS. 9B and 9C illustrate the non-washing mode. Hereinafter, a process in which the washing machine 1 washes laundry will be described with reference to FIGS. 9A, 9B, and 9C.

The user inserts the laundry to be washed into the washing machine 1. Here, the washing machine 1 may be disposed as shown in FIG. 9C. The driving unit 100 applies a driving force to the tub 30 in such a way that the tub 30 and the front panel 11 are disposed adjacent to each other and the opening 12 provided in the front panel 11 are open. The user inserts the laundry into the tub 30 through the opening 12. Specifically, the laundry may be positioned in the drum 40 provided inside the tub 30.

After that, as shown in FIG. 9B, the user closes the opening 12 and turns on the power of the washing machine 1 by pressing the power button 13. Also, the user may insert a necessary detergent into the detergent box 16 or may select a preferable washing mode through the operation unit 14.

The washing machine 1 whose power is turned on may be switched from a non-washing mode into the washing mode, and the driving unit 100 may be operated. The driving unit 100 removes the driving force from the tub 30. As shown in FIG. 9A, the tub 30 may be disposed to be spaced from the front panel 11. Through a washing cycle and a spin-drying cycle, the drum 40 rotates and washes the laundry therein.

When the washing is completed, the driving unit operates and moves the tub 30 to be adjacent to the front panel 11. Accordingly, the washing machine 1 is disposed again as shown in FIG. 9B. As shown in FIG. 9C, the user may open the opening 12 and may take out the washed laundry therein.

FIGS. 10 to 13 are views illustrating various embodiments of a driving unit. They are merely examples and various driving units capable of providing a driving force may be included. The description with reference to FIGS. 1 to 9C will be referred to where applicable.

Figure 10:
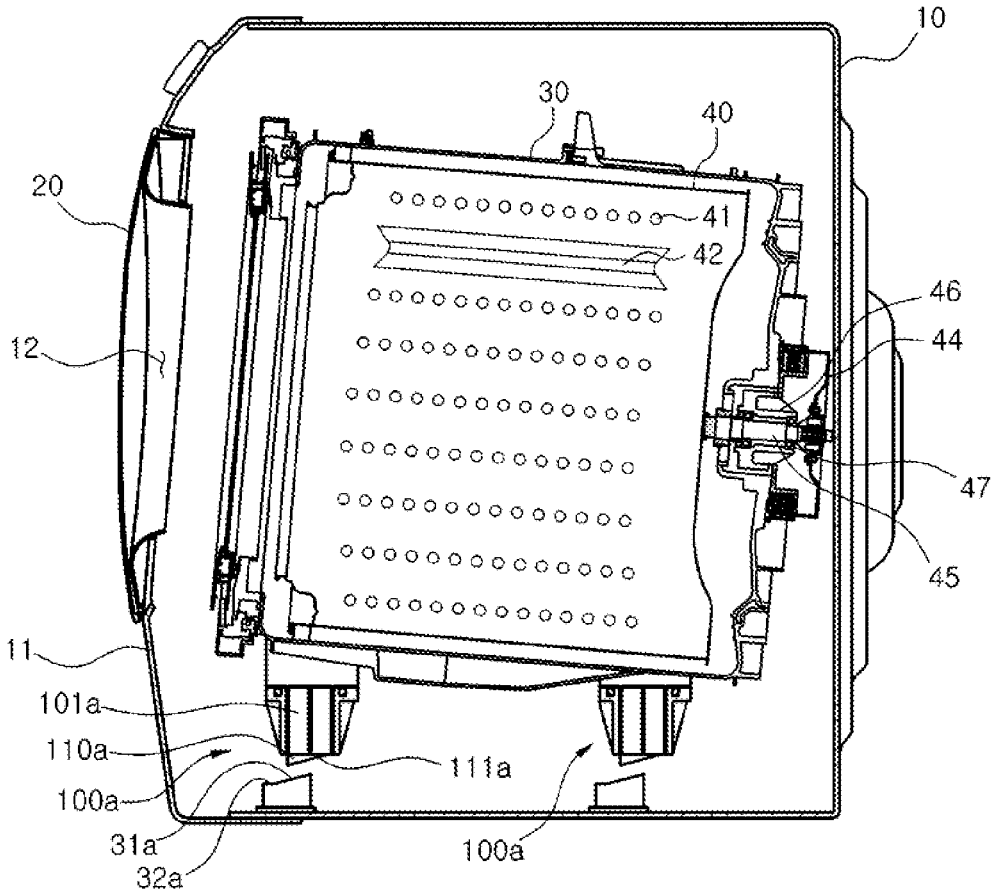
FIG. 10 is a side cross-sectional view of a driving unit and a tub of the washing machine according to another embodiment of the present disclosure.

FIG. 10 is a view of a driving unit 100*a* and the tub 30 of the washing machine 1 according to another embodiment of the present disclosure.

The driving unit 100*a* may include a moving contact surface 111*a* and the plurality of driving units may be installed inside the cabinet 10. For example, the driving unit 100*a* may be installed on each of both sides of a rear portion of the tub 30. Also, the driving unit 100*a*, as shown in FIG. 10, may be installed on each of a front and a rear of the tub 30.

Also, the driving unit 100*a* may be installed at the tub 30. That is, a fixed portion 101*a* may be fixed to the tub 30 and a moving portion 110*a* may be installed to be movable from the tub 30 to the cabinet 10. A tub contact surface 31*a* corresponding to the moving contact surface 111*a* provided on the moving portion 110*a* may be provided on the cabinet 10. When the moving portion 110*a* is provided on the tub 30 as shown in FIG. 10, it may be convenient to assemble the washing machine 1.

Accordingly, as the moving portion 110*a* descends, the moving contact surface 111*a* and at least a part of the tub contact surface 31*a* may be in contact with each other. The moving portion 110*a* continuously descends, and the moving contact surface 111*a* moves along the tub contact surface 31*a*. Accordingly, the tub 30 may move toward the front of the cabinet 10. A stopper portion 32*a* provided on one side of the tub contact surface 31*a* and the moving contact surface 111*a* are in contact with each other, thereby preventing sliding. The moving portion 110*a* continuously descends, and the tub 30 may move to a top of the cabinet 10.

Figure 11:
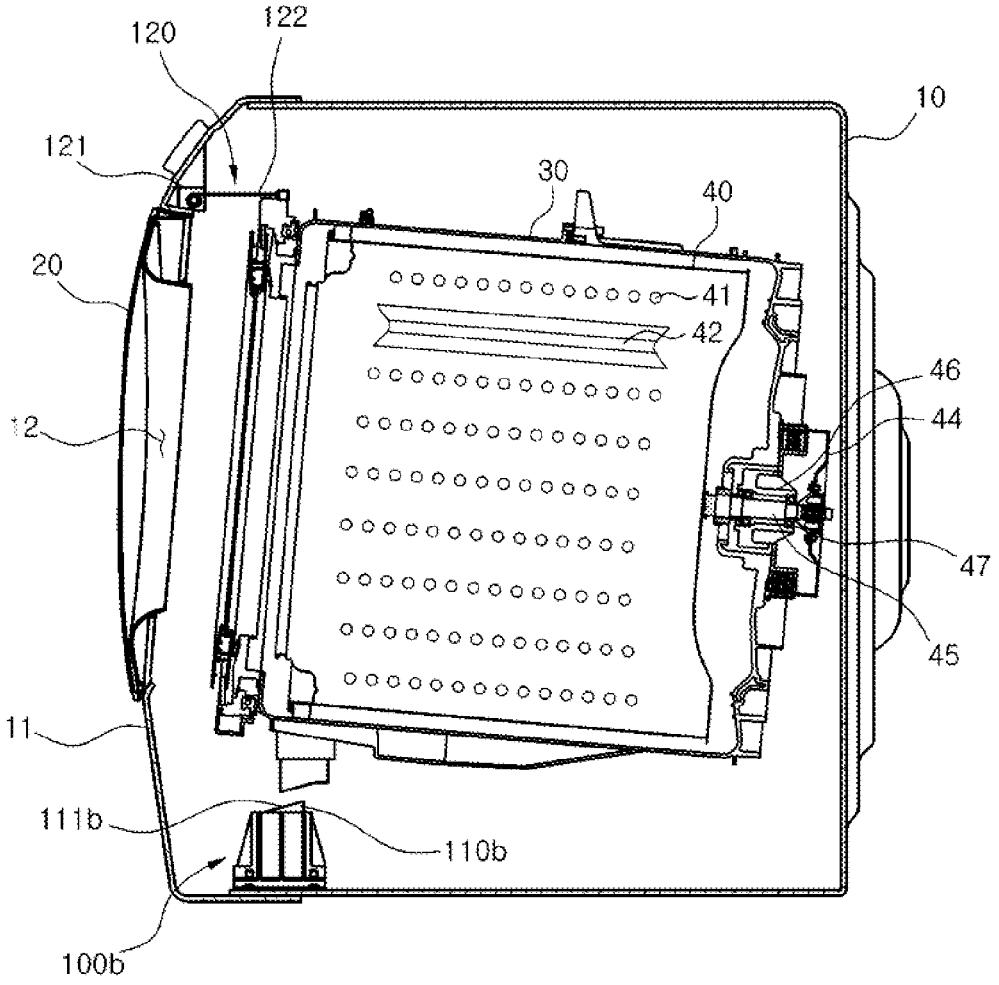
FIG. 11 is a side view of a driving unit and a tub of a washing machine according to still another embodiment of the present disclosure.

FIG. 11 is a side view of driving unit 100*b* and driving unit 120 and the tub 30 of the washing machine 1 according to still another embodiment of the present disclosure.

The driving unit 120 may be provided including a wire motor 121 and a wire 122. One end of the wire 122 may be disposed at the front panel 11, and the other end thereof may be disposed at the tub 30. The wire motor 121 may be installed to change a length of the wire 122. For example, the wire 122 is wound on or unwound from a rotation shaft of the wire motor 121, thereby changing the length of the wire 122.

As shown in FIG. 11, the wire motor 121 and one end of the wire 122 are disposed on the front panel 11 and the other end of the wire 122 is disposed on the tub 30. According to an operation of the wire motor 121, the length of the wire 122 changes, thereby allowing the tub 30 to move toward the front panel 11. According to installation positions of the wire motor 121 and the wire 122, the tub 30 may move to a certain position.

Hereinafter, a driving unit 100 including a moving portion 110*b* provided with a moving contact surface 111*b* formed as an inclined plane is referred to as a first driving unit 100*b*, and a driving unit 100 using the wire 122 is referred to as a second driving unit 120. As described above, the first driving unit 100*b* and the second driving unit 120 may be installed separately to move the tub 30.

Also, as shown in FIG. 11, the first driving unit 100*b* and the second driving unit 120 may be installed together to move the tub 30. In FIG. 11, the first driving unit 100*b* may be disposed in a front lower portion of the tub 30 and the second driving unit 120 may be disposed in a front upper portion of the tub 30. The moving portion 110*b* provided at the first driving unit 100*b* may push the tub upward and forward, and the wire 122 provided at the second driving unit 120 may pull the tub 30 forward.

Figure 12:
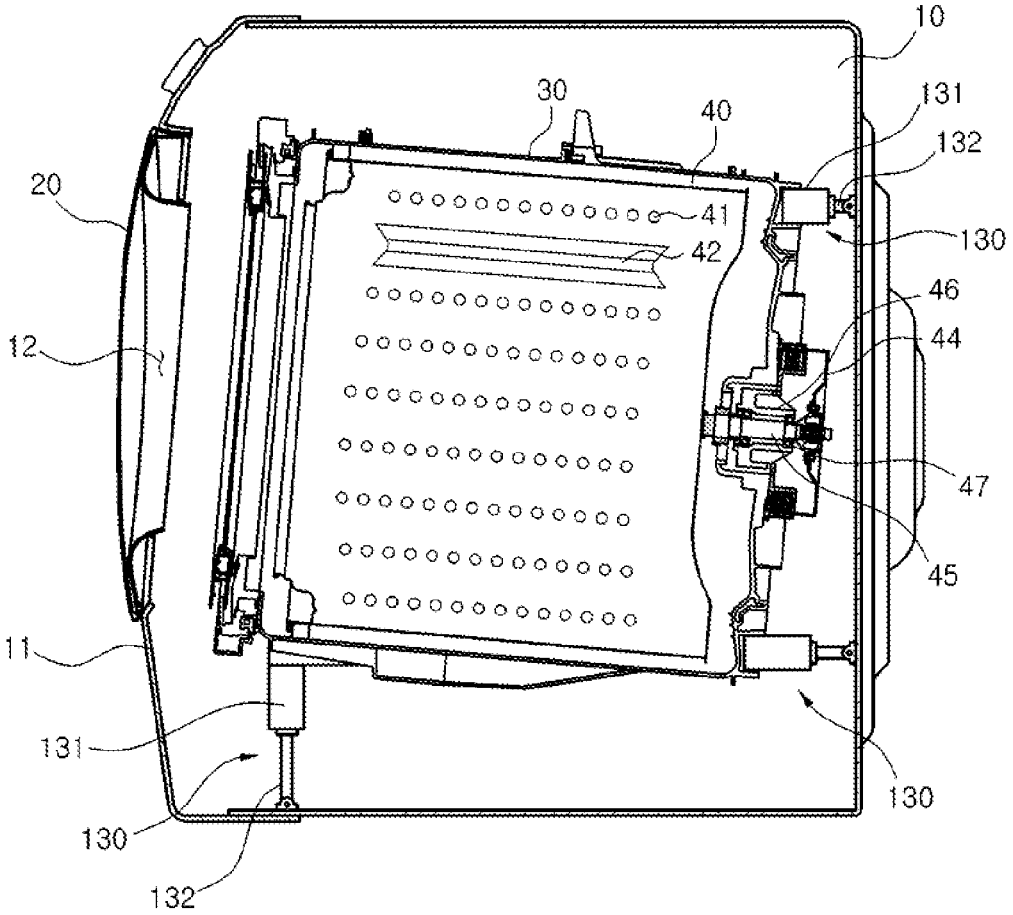
FIG. 12 is a side view of a driving unit and a tub of a washing machine according to yet another embodiment of the present disclosure.

FIG. 12 is a view illustrating of a driving unit 130 and the tub 30 of the washing machine 1 according to yet another embodiment of the present disclosure. The driving unit 130 shown in FIG. 12 is referred to as a third driving unit 130.

The third driving unit 130 may include a cylinder 131 and a piston 132 movably installed at the cylinder 131. The cylinder 131 is filled with a fluid and may move the piston 132 while inpouring and outpouring the fluid. As shown in FIG. 12, when the cylinder 131 is provided at the tub 30, one side of the piston 132 may be pivotably installed on the inner surface of the cabinet 10. A length of the piston 132 exposed outside the cylinder 131 may change and a driving force may be applied to the tub 30.

The plurality of third driving units 130 may be installed. For example, as shown in FIG. 12, the third driving units 130 may be installed at a front bottom of the tub 30 and may be installed at a rear top and bottom of the tub 30, respectively.

Also, the third driving unit 130 may be installed together with the first driving unit 100*b* and the second driving unit 120. That is, the tub 30 may be moved using at least one of the first driving unit 100*b*, the second driving unit 120, and the third driving unit 130.

Figure 13:
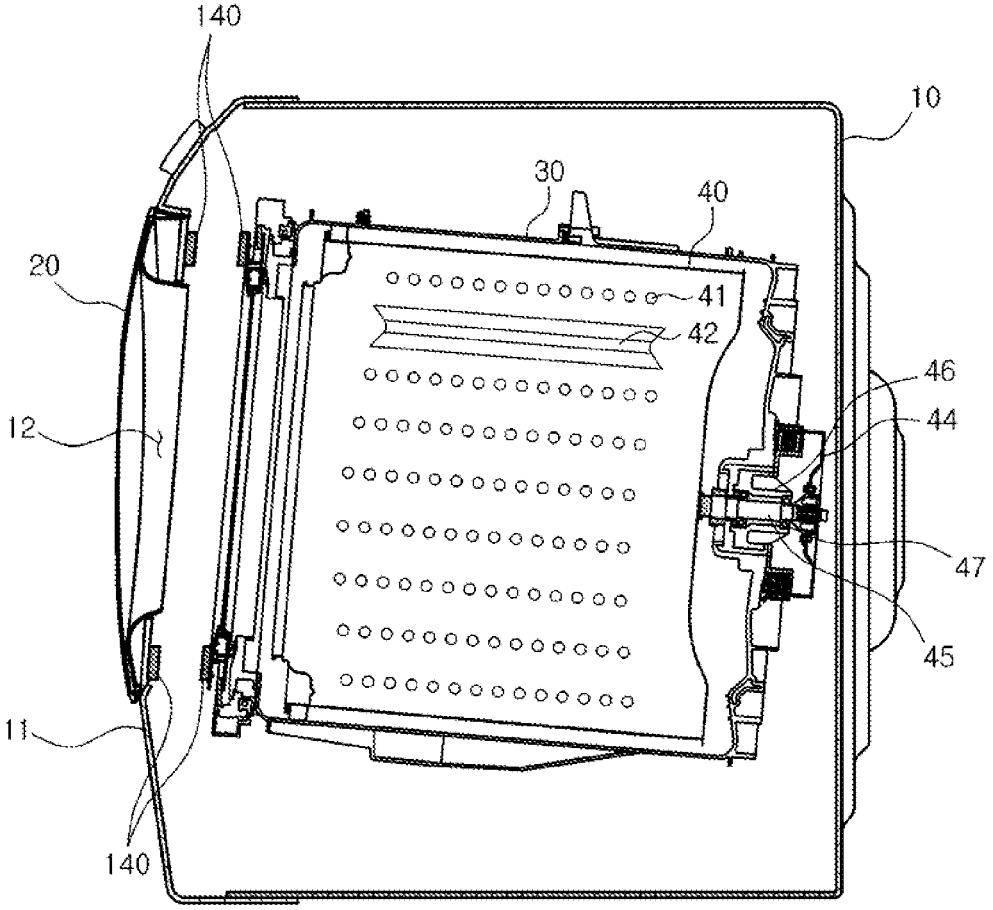
FIG. 13 is a side view of a driving unit and a tub of a washing machine according to even another embodiment of the present disclosure.

FIG. 13 is a side view of a driving unit 140 and the tub 30 of the washing machine 1 according to even another embodiment of the present disclosure. The driving unit 140 shown in FIG. 13 is referred to as a fourth driving unit 140.

The fourth driving unit 140 may be provided as a magnet. The fourth driving unit 140 may be disposed at each of the tub 30 and the front panel 11. The tub 30 may be coupled with or separated from the front panel 11 while moving due to a magnetic force.

Here, the fourth driving unit 140 may include an electromagnet, an electro permanent magnet, and a magnetic base. The electromagnet and the electro permanent magnet may couple or separate the tub 30 with or from the front panel 11 depending on an input of an electric current. The magnetic base may couple or separate the tub 30 with or from the front panel 11 by turning on/off a magnetic force. Also, the magnetic base may adjust a distance between the tub 30 and the front panel 11 by controlling the magnetic force.

Figure 14:
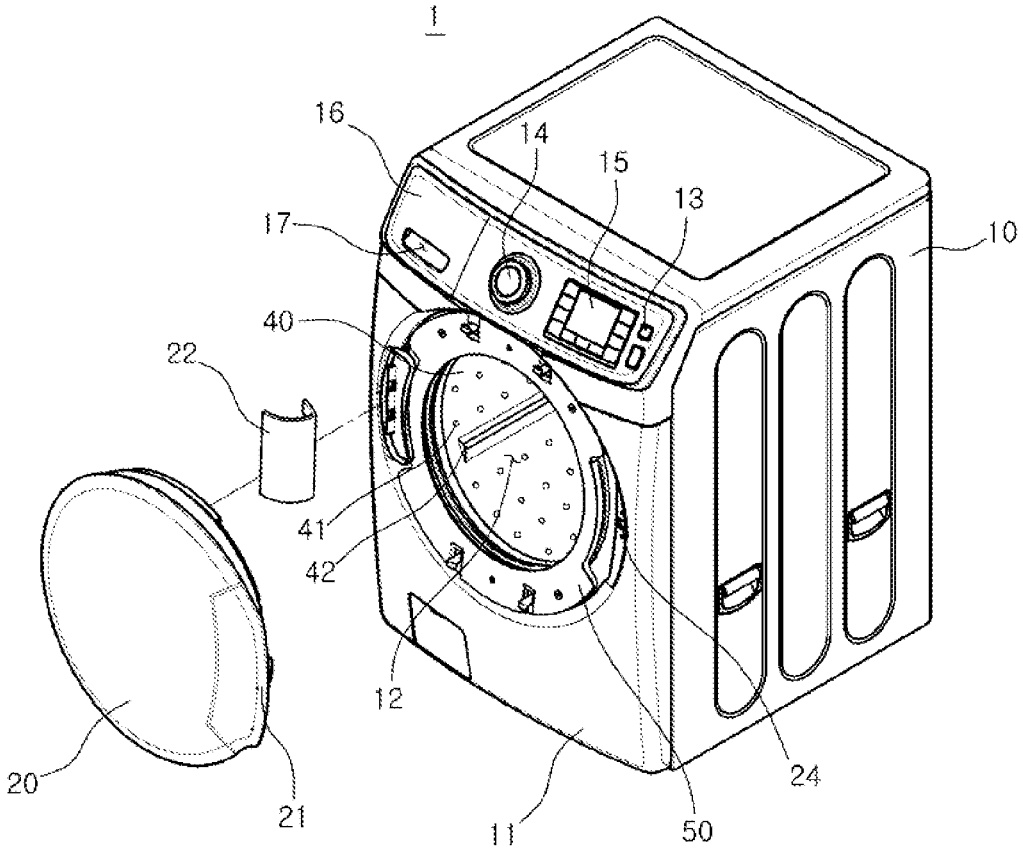
FIG. 14 is a view of an outer door disassembled from the washing machine according to one embodiment of the present disclosure.

FIG. 14 is a view of the outer door 20 disassembled from the washing machine 1 according to one embodiment of the present disclosure.

As described above, the front panel 11 may include the opening 12 and the outer door 20 which opens and closes the opening 12. Also, the outer door 20 may be pivotably coupled with one side of the front panel 11 to open and close the opening 12. The outer door 20 may be at least partially transparent to allow the user to check the inside of the washing machine 1. A door grip portion 21 may be provided at one side of the outer door 20 to allow the user to grip it to pivot the outer door 20.

The outer door 20 may be pivotably installed by a hinge member 22. The hinge member 22 may be installed to connect the front panel 11 with the outer door 20. That is, the hinge member 22 may pivotably couple the outer door 20 with the front panel 11.

Also, the washing machine 1 may include door lock structures 23 and 24 which fix the outer door 20 to the front panel 11. For example, the door lock structures 23 and 24 may be formed of a locking hook 23 (refer to FIG. 9C) installed at the outer door 20 and a locking groove 24 formed at the front panel 11. Depending on whether it is the washing mode or the non-washing mode, the outer door 20 is locked in or released from the front panel 11 by moving the locking hook 23.

Accordingly, as shown in FIG. 9C, the outer door 20 may pivot from the front panel 11 at a certain angle. Also, to prevent the user from opening the opening 12 in the washing mode, the outer door 20 may be fixed to the front panel 11 using the door lock structures 23 and 24.

Also, the tub 30 may include an inner door 50 to prevent a water leakage from the tub 30. The inner door 50 may be provided separately from the outer door 20. In the case of the washing mode, it is necessary for the inner door 50 to be coupled with the tub 30 to prevent the leakage of the washing water inside the tub 30. In the case of the non-washing mode, it is necessary for the opening 12 to be open to allow the user to insert or take out the laundry. Here, for convenience of the user, the inner door 50 may be provided to be pivotable together according to pivoting of the outer door 20.

Accordingly, the inner door 50 may be coupled with the outer door 20 in the non-washing mode and may be coupled with the tub 30 in the washing mode. That is, the inner door 50 may be selectively coupled with one of the outer door 20 and the tub 30.

Hereinafter, a structure of coupling the inner door 50 with the outer door 20 will be described with reference to FIGS. 15 to 19 and a structure of coupling the inner door 50 with the tub 30 will be described with reference to FIGS. 20 to 23.

Figure 15:
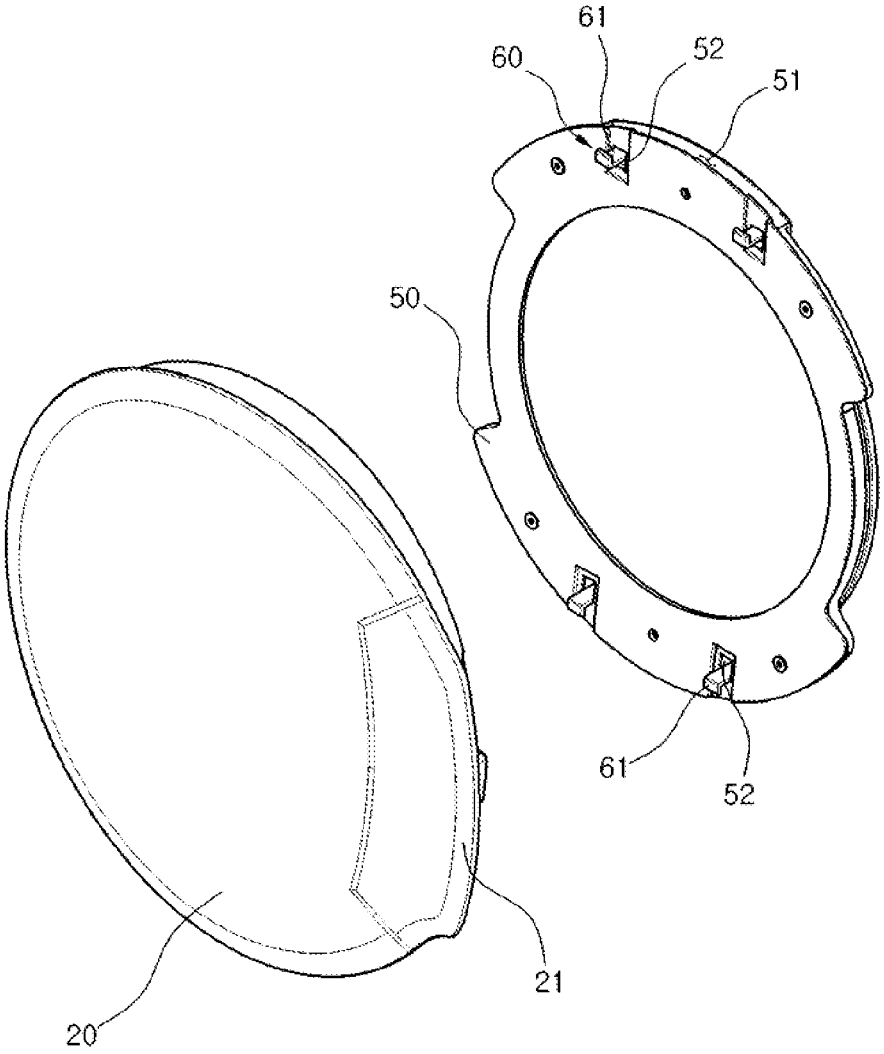
FIGS. 15 and 16 are views of the outer door and an inner door of the washing machine according to one embodiment of the present disclosure.
Figure 16:
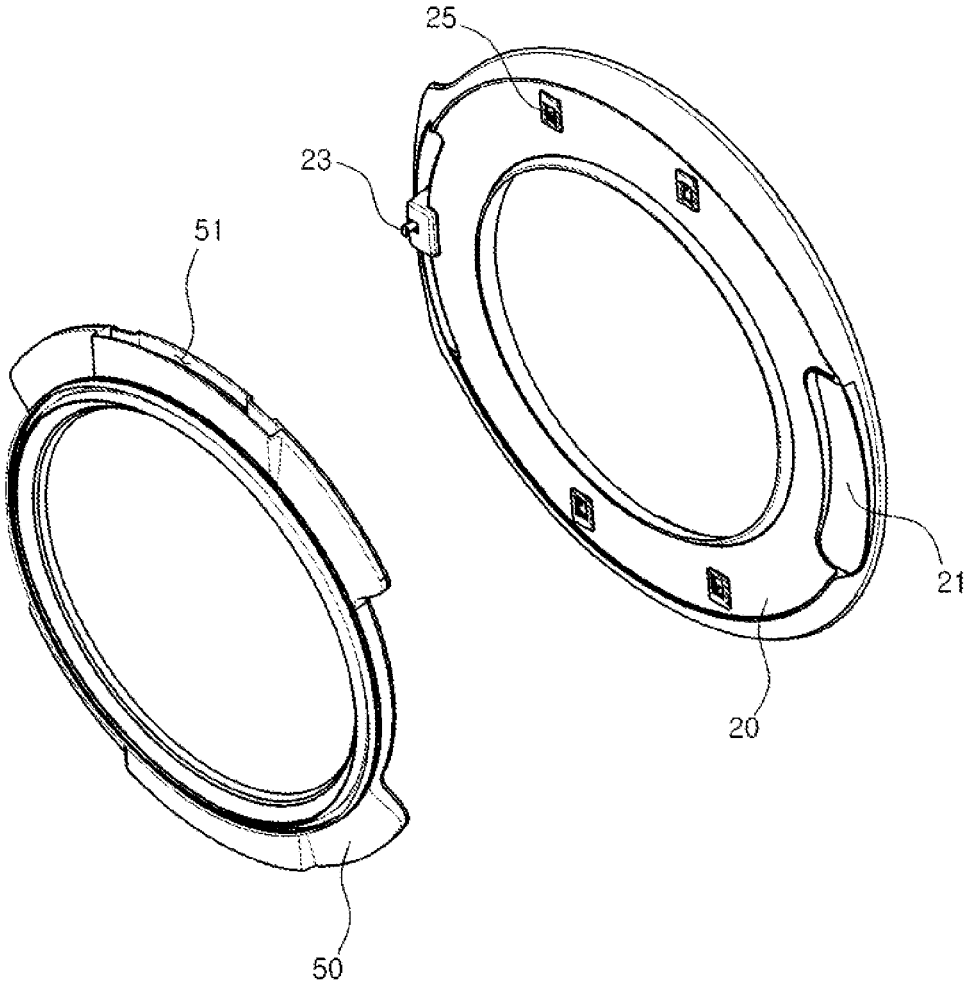

FIGS. 15 and 16 are views of the outer door 20 and the inner door 50 of the washing machine 1 according to one embodiment of the present disclosure.

The inner door 50 may be at least partially transparent to allow the user to check the inside of the washing machine 1. Accordingly, the user may check the laundry loaded in the drum 40 through the outer door 20 and the inner door 50 transparently provided.

Also, both sides of the inner door 50 may be concave to avoid interference between the hinge member 22 and the door lock structures 23 and 24. As shown in FIG. 14, the inner door 50, the hinge member 22, and the door lock structures 23 and 24 are arranged not to overlap one another. Accordingly, the outer door 20 may pivot from the front panel 11 or may be fixed to the front panel 11 regardless of being coupled with the inner door 50.

The inner door 50 and the outer door 20 may be detachably coupled with each other. For coupling between the inner door 50 and the outer door 20, a first coupling member 60 may be provided. The first coupling member 60 may be provided on at least one of the inner door 50 and the outer door 20. Hereinafter, an example in which the inner door 50 includes the first coupling member 60 will be described.

At least a part of the first coupling member 60 may be disposed inside the inner door 50. The inner door 50 may include an internal coupling space 51 in which the first coupling member 60 is installed. The internal coupling space 51 may be provided in each of a top and a bottom of the inner door 50.

Also, the plurality of first coupling members 60 may be provided in the internal coupling space 51. FIGS. 15 and 16 illustrate a case in which two first coupling members 60 are disposed in one internal coupling space 51. That is, four first coupling members 60 are provided on the inner door 50. Since they include the same configuration and operate in the same manner, one of them will be described.

The first coupling member 60 may include a door coupling hook 61. The internal coupling space 51 may include an inner moving groove 52 to allow at least a part of the door coupling hook 61 to be disposed outside. As shown in FIG. 15, at least the part of the door coupling hook 61 is disposed outside the internal coupling space 51 through the inner moving groove 52.

The outer door 20 may include a door coupling groove 25 corresponding to the door coupling hook 61. As shown in FIG. 16, the door coupling groove 25 may be disposed to correspond to the door coupling hook 61. Hereinafter, the outer door 20 and the inner door 50 coupled by the first coupling member 60 will be described.

Figure 17:
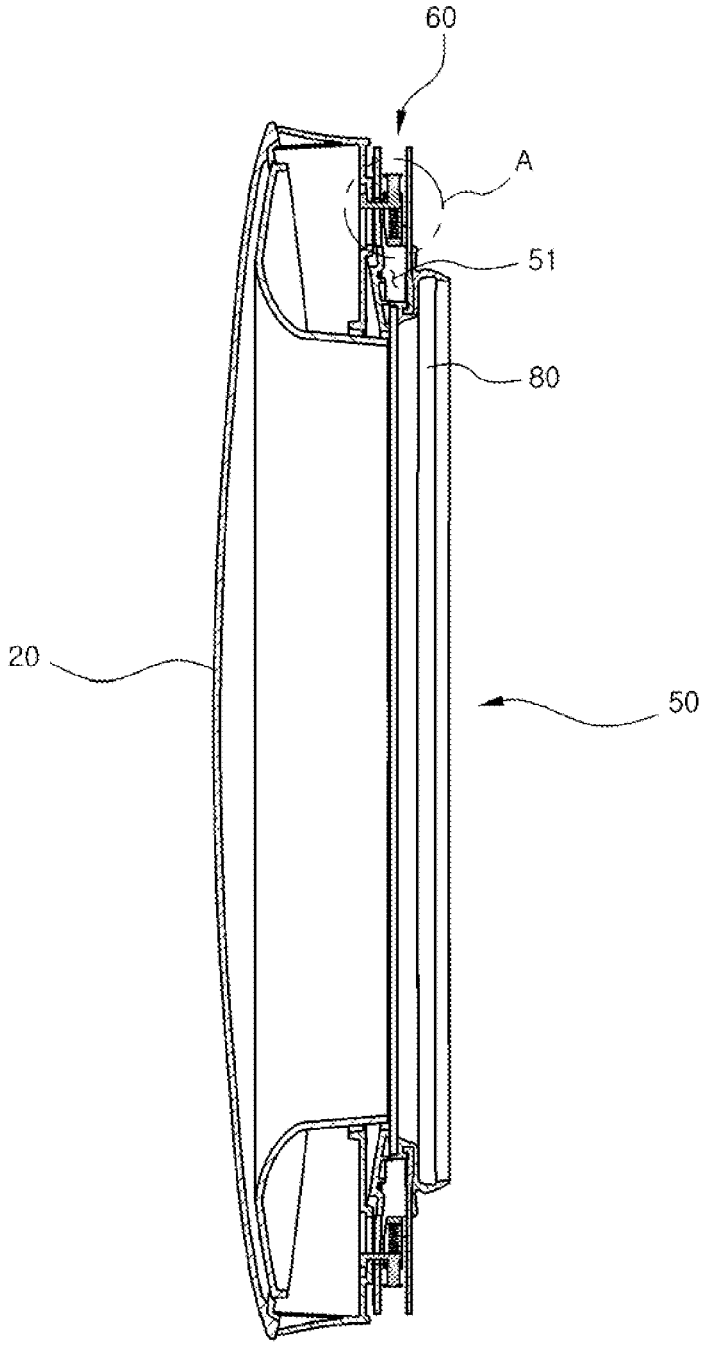
FIG. 17 is a side cross-sectional view illustrating coupling between the outer door and the inner door of the washing machine according to one embodiment of the present disclosure.
Figure 18:
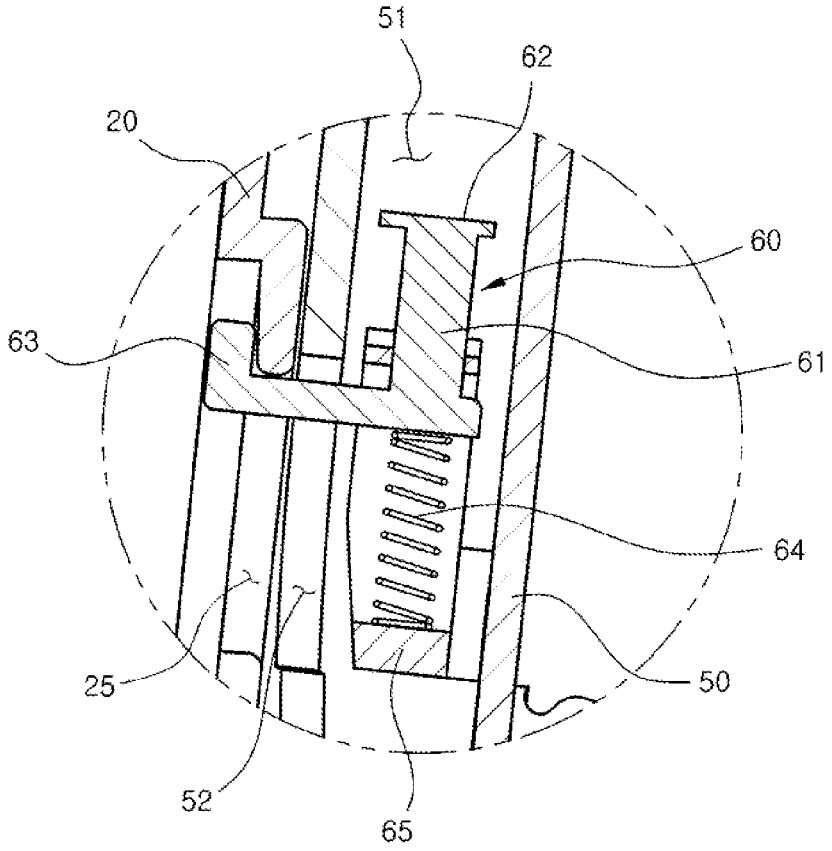
FIG. 18 is an enlarged view illustrating portion A of FIG. 17.

FIG. 17 is a side cross-sectional view illustrating coupling between the outer door 20 and the inner door 50 of the washing machine 1 according to one embodiment of the present disclosure. FIG. 18 is an enlarged view illustrating portion A of FIG. 17.

The door coupling hook 61 may include a pressurized portion 62 and a holding portion 63. The pressurized portion 62 and the holding portion 63 may be provided at one end and the other end of the door coupling hook 61, respectively.

The pressurized portion 62 is a part to which an external force is applied and may be flat to stably receive the force. The holding portion 63 may extend in a pivoting direction and a vertical direction to be coupled with the inner door 50 when the outer door 20 pivots.

As described above, one part of the door coupling hook 61 is located inside the internal coupling space 51 and the other part passes through the inner moving groove 52 and is located outside the internal coupling space 51. Here, the pressurized portion 62 may be located on one end of the door coupling hook 61 located inside the internal coupling space 51 and the holding portion 63 may be located on the other end of the door coupling hook 61 located outside the internal coupling space 51.

Also, the door coupling hook 61 may be movably installed in the internal coupling space 51. The door coupling hook 61 may move due to the external force applied to the pressurized portion 62.

As shown in FIGS. 17 and 18, the outer door 20 and the inner door 50 are in contact with each other to allow the inner moving groove 52 to correspond to the door coupling groove 25. That is, the inner moving groove 52 and the door coupling groove 25 may have similar sizes.

FIGS. 17 and 18 illustrate a state in which the external force is not applied to the pressurized portion 62. Here, the holding portion 63 may pass through the inner moving groove 52 and may be located in front of a rear surface of the outer door 20. Accordingly, when the user holds the door grip portion 21 and pivots the outer door 20, the inner door 50 may pivot together due to the holding portion 63. When the external force is applied to the pressurized portion 62, the door coupling hook 61 may move. Here, the holding portion 63 may be located in the door coupling groove 25, and the outer door 20 and the inner door 50 may be separated from each other.

Figure 19:
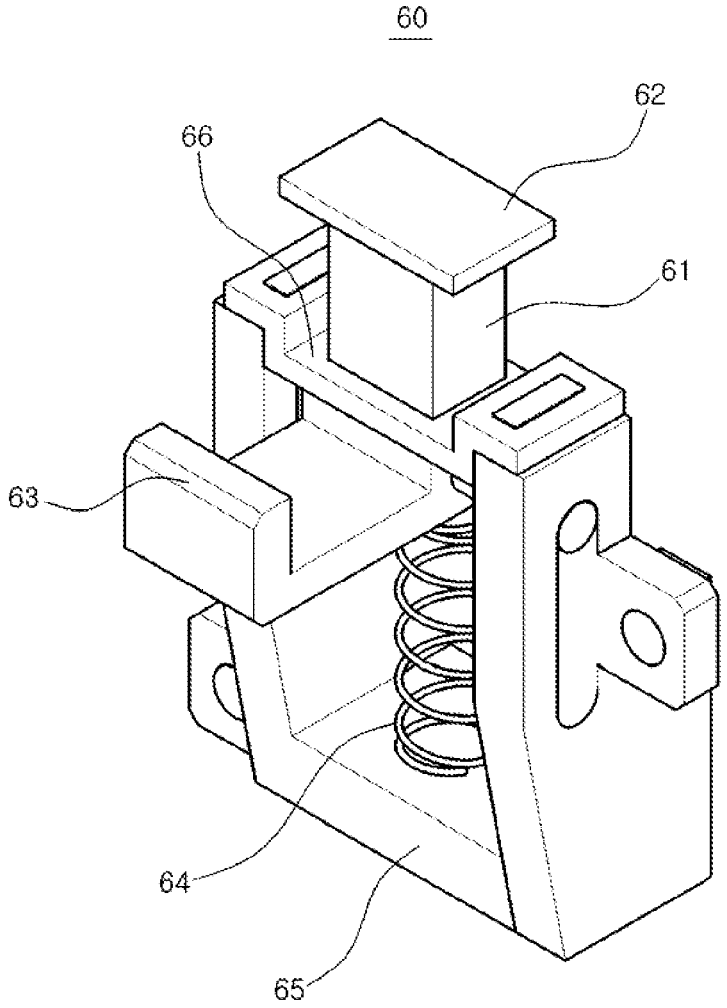
FIG. 19 is a view of a first coupling member of the washing machine according to one embodiment of the present disclosure.

FIG. 19 is a view of the first coupling member 60 of the washing machine 1 according to one embodiment of the present disclosure.

As described above, the first coupling member 60 may include the door coupling hook 61 provided with the pressurized portion 62 and the holding portion 63. Also, the first coupling member 60 may include a hook case 65 and a hook spring 64.

The hook case 65 may movably support the door coupling hook 61. The hook case 65 may include a hook guide 67 which guides the movement of the door coupling hook 61. The door coupling hook 61 may be at least partially inserted into the hook guide 67 during moving. The hook case 65 may include a hook cover 66 which restricts the movement of the door coupling hook 61. The hook cover 66 may be provided to allow the door coupling hook 61 to be movable within a predetermined range.

One end of the hook spring 64 may be coupled with the door coupling hook 61 and the other end may be coupled with the hook case 65. When the external force is applied to the pressurized portion 62, the hook spring 64 may be compressed and the door coupling hook 61 may move. When the external force is removed from the pressurized portion 62, the hook spring 64 may extend and the door coupling hook 61 may move to an original position.

Figure 20:
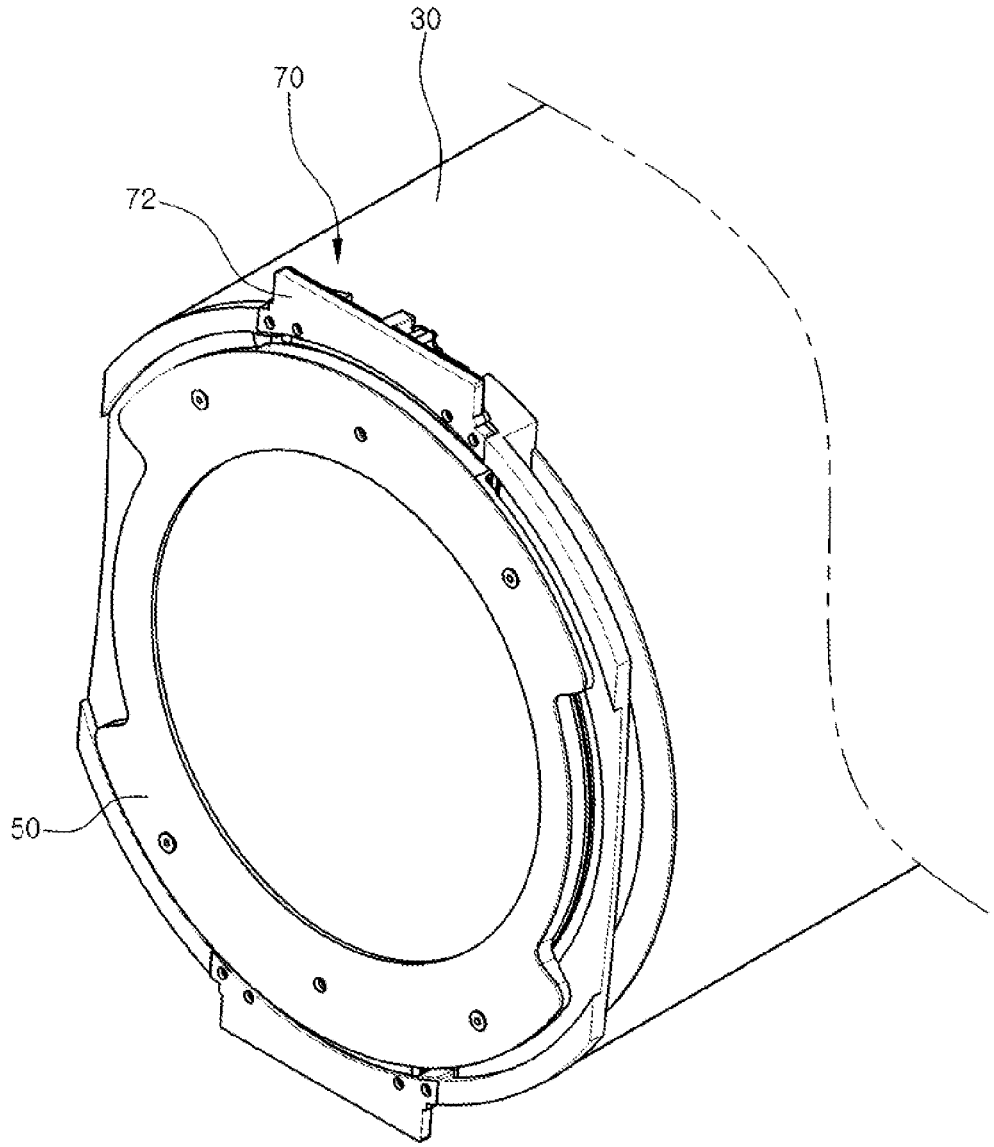
FIG. 20 is a view of the inner door and the tub of the washing machine according to one embodiment of the present disclosure.
Figure 21:
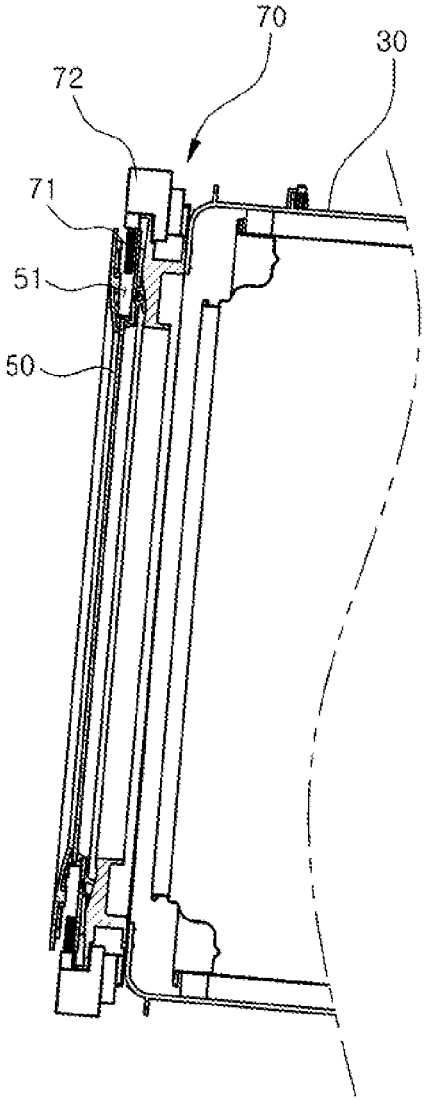
FIG. 21 is a partial side cross-sectional view illustrating coupling between the inner door and the tub of the washing machine according to one embodiment of the present disclosure.

FIG. 20 is a view illustrating of the inner door 50 and the tub 30 of the washing machine 1 according to one embodiment of the present disclosure. FIG. 21 is a partial side cross-sectional view illustrating coupling between the inner door 50 and the tub 30 of the washing machine 1 according to one embodiment of the present disclosure.

For coupling between the inner door 50 and the tub 30, a second coupling member 70 may be provided. The second coupling member 70 may be provided on at least one of the inner door 50 and the tub 30. Hereinafter, an example in which the inner door 50 includes the second coupling member 70 will be described.

The plurality of second coupling members 70 may be provided. As shown in FIGS. 20 and 21, the second coupling members 70 may be provided on the top and bottom of the tub 30, respectively. Since they include the same configuration and operate in the same manner, one of them will be described.

The second coupling member 70 may include a latch 71. As shown in FIG. 21, the latch 71 may be disposed to be insertable into the internal coupling space 51. As the latch 71 is inserted into the internal coupling space 51, the tub 30 and the inner door 50 may move together. The latch 71 may be inserted into each of the top and bottom of the inner door 50 and may stably couple the tub 30 with the inner door 50. Hereinafter, the second coupling member 70 will be described in detail.

Figure 22:
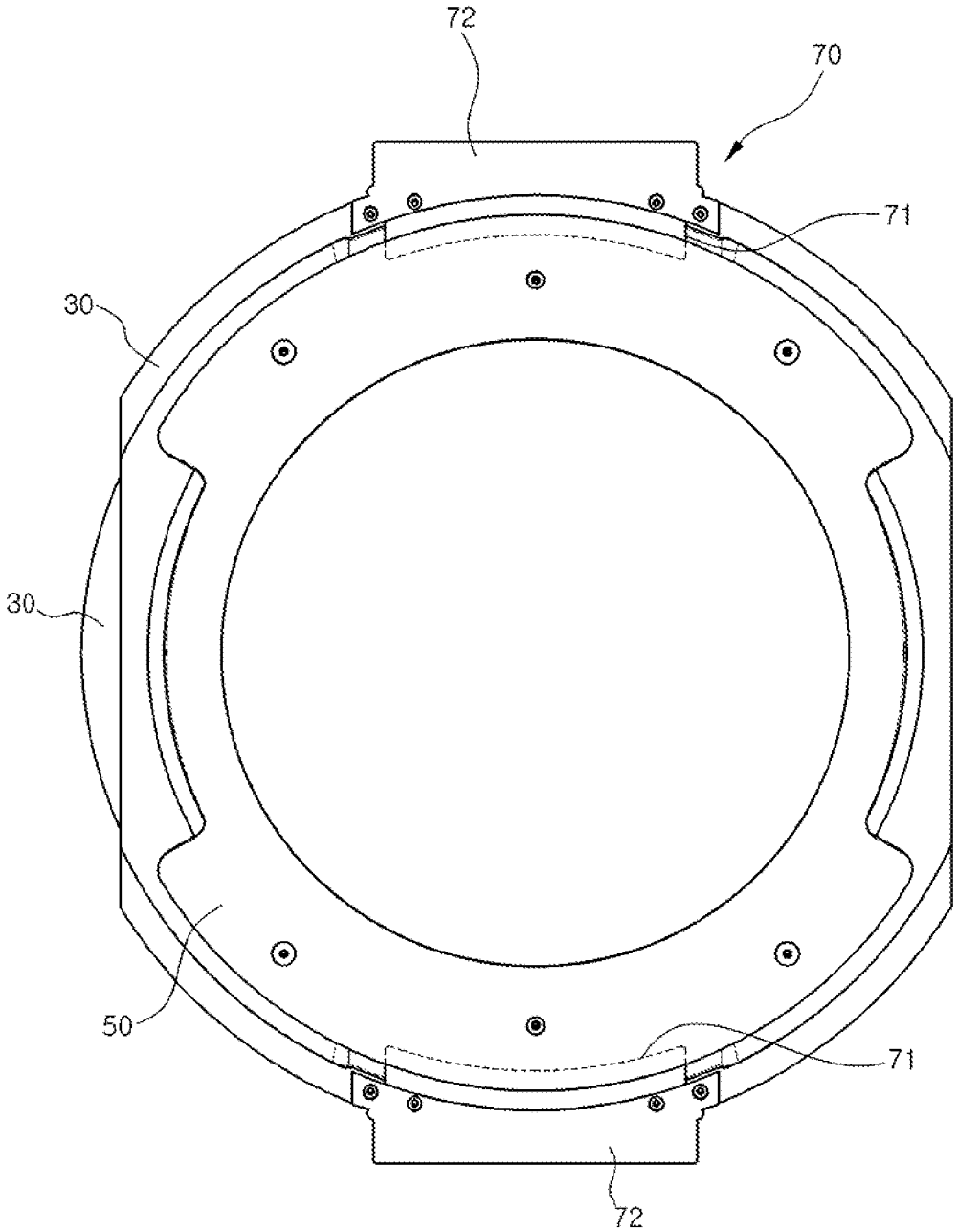
FIG. 22 is a front view illustrating coupling between the inner door and the tub of the washing machine according to one embodiment of the present disclosure.
Figure 23:
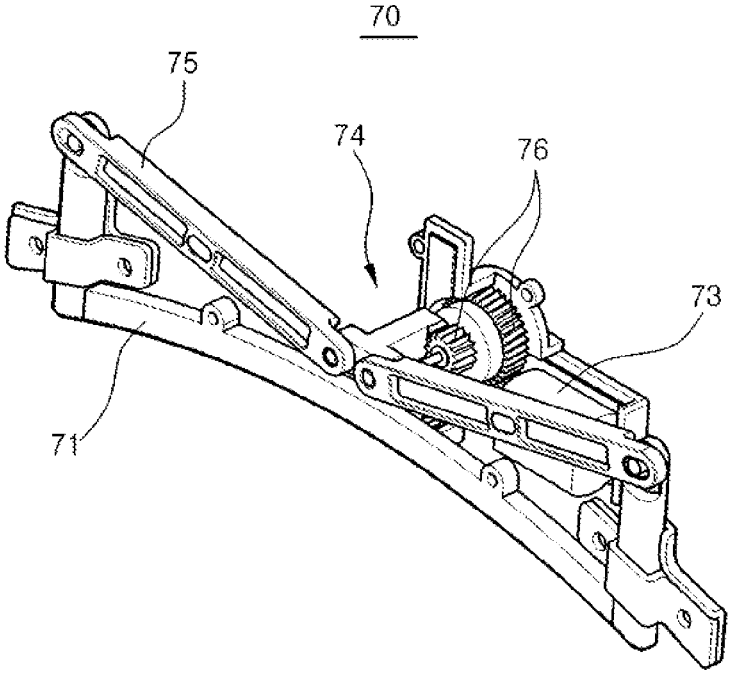
FIG. 23 is a view of a second coupling member of the washing machine according to one embodiment of the present disclosure.

FIG. 22 is a view of the tub 30 and the second coupling member 70 of the washing machine 1 according to one embodiment of the present disclosure. FIG. 23 is a view of the second coupling member 70 of the washing machine 1 according to one embodiment of the present disclosure. FIG. 23 illustrates an internal structure of the second coupling member 70 while omitting a latch casing 72.

The second coupling member 70 may include the latch 71 and the latch casing 72 in which the latch 71 is stored. As shown in FIG. 22, the latch casing 72 may be installed at a front portion of the tub 30. The latch 71 may be installed to be movable from the inside of the latch casing 72 to the outside thereof. The latch 71 which moves outside the latch casing 72 may be inserted into the internal coupling space 51.

As shown in FIG. 23, the second coupling member 70 may include a latch motor 73 which provides a driving force for the latch 71 and a latch transfer member 74 which transfers the driving force of the latch motor 73 to the latch 71. For example, the latch transfer member 74 may include links 75 and latch connecting gears 76 which connect the links 75 with the latch motor 73.

As further shown in FIG. 23, one end of the link 75 may be connected to the latch 71 and the other end may be connected to the latch connecting gears 76. The latch connecting gears 76 may have various forms such as worm gears, circular gears, and racks. The latch connecting gears 76 connected to a rotating shaft of the latch motor 73 may linearly change and transfer the driving force of the latch motor 73. Accordingly, the one end of the link 75 connected to the latch connecting gears 76 may linearly move.

As shown in FIG. 23, the one end of the link 75 connected to the latch connecting gears 76 may be disposed below the other end. Here, the latch motor 73 is driven and the latch connecting gears 76 lift the one end of the link 75. As the one end of the link 75 is lifted, the other end descends and the latch 71 connected to the other end may descend. Also, the latch motor 73 is reversely driven in such a way that the latch connecting gears 76 may allow the one end and the other end of the link 75 to descend and ascend, thereby lifting the latch 71.

Figure 24A:
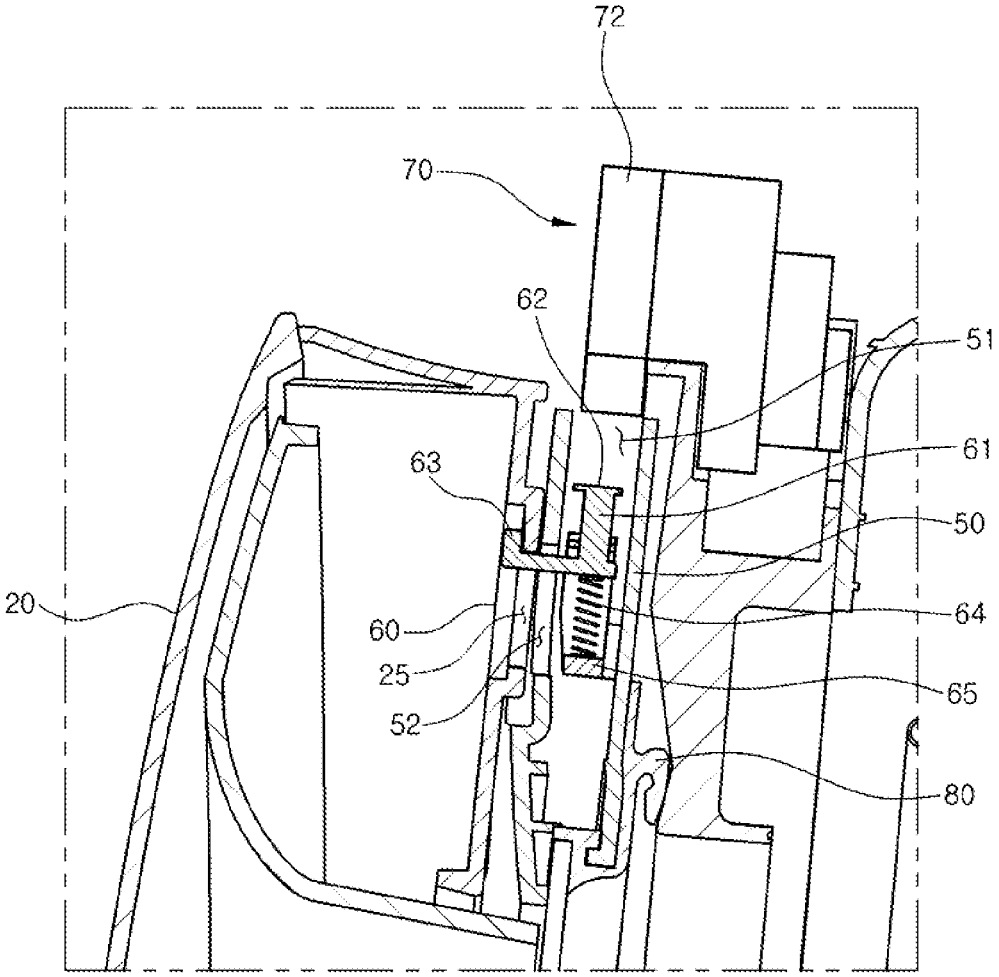
FIGS. 24A, 24B, and 24C are partial side cross-sectional views illustrating the operation of the washing machine according to one embodiment of the present disclosure.
Figure 24B:
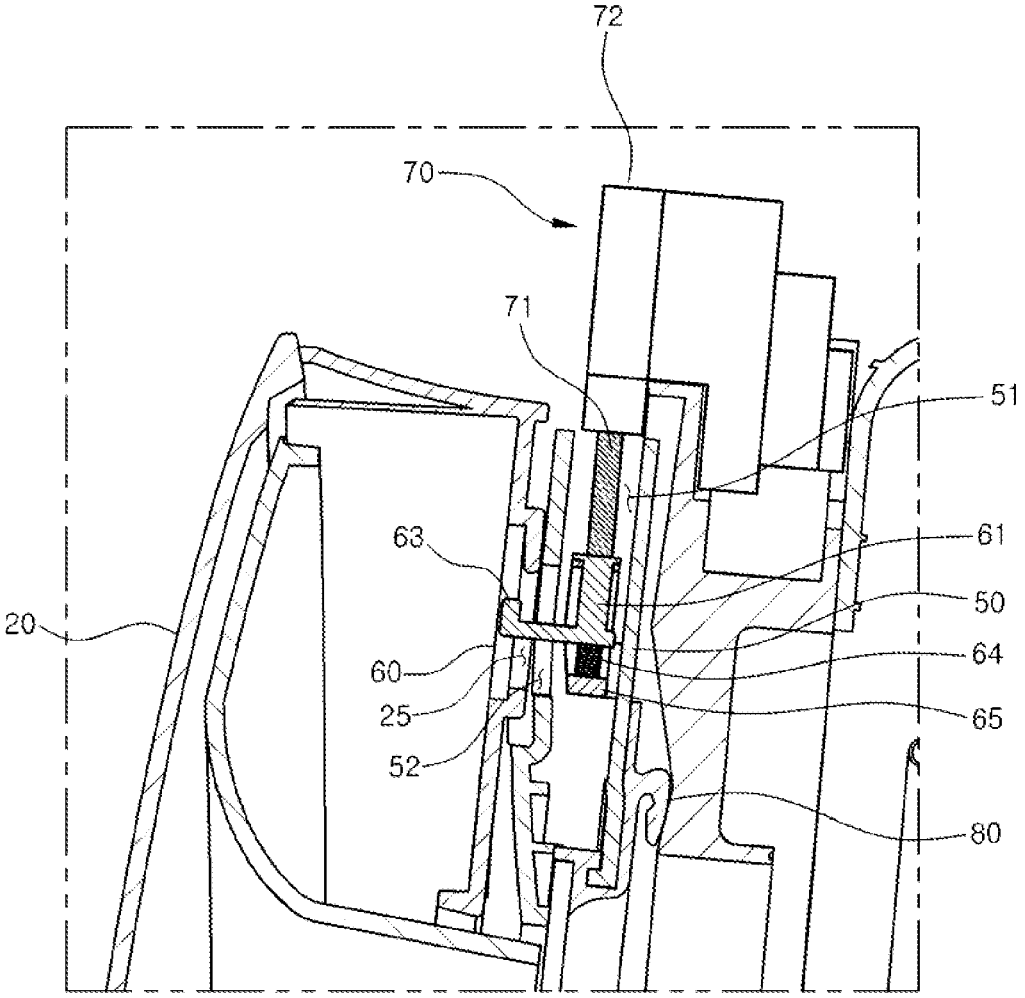
Figure 24C:
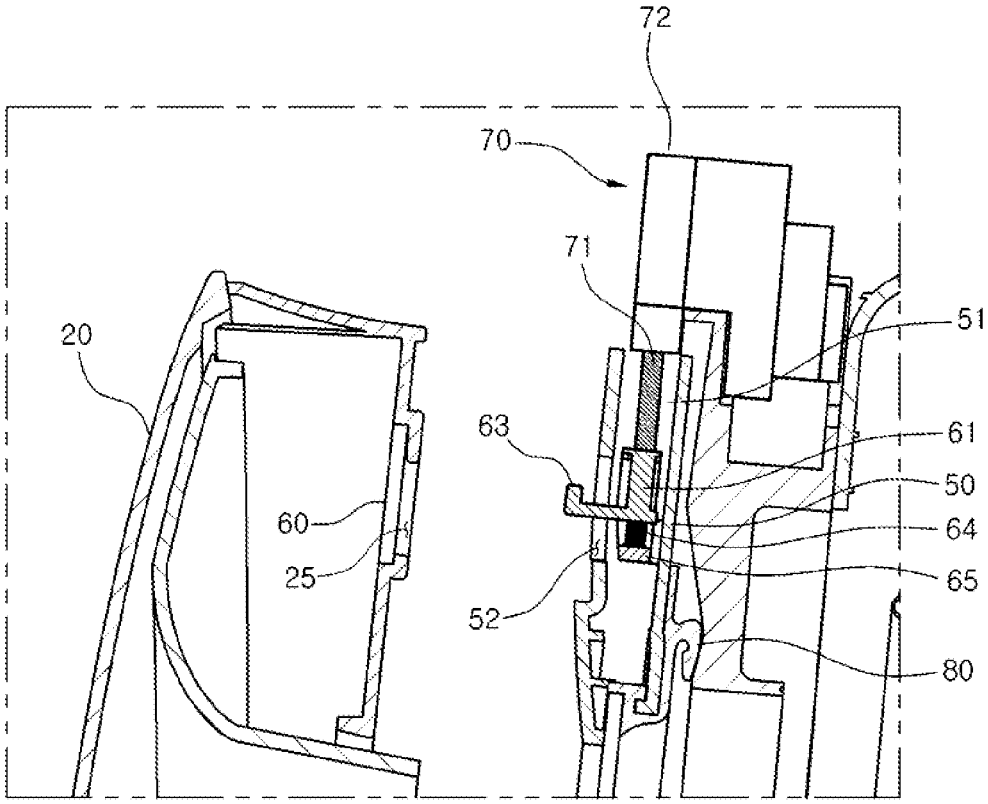

FIGS. 24A, 24B, and 24C are side cross-sectional views illustrating an operation of the washing machine 1 according to one embodiment of the present disclosure.

The first coupling member 60 and the second coupling member 70 may be disposed to be interlocked with each other. That is, the door coupling hook 61 and the latch 71 may be moved using one latch motor 73. The latch 71 may operate as the external force applied to the pressurized portion 62.

In the non-washing mode, as shown in FIG. 24A, the outer door 20 and the inner door 50 are coupled with each other. The door coupling hook 61 may connect the outer door 20 with the inner door 50 to pivot together. When the external force is not applied to the door coupling hook 61, the latch 71 may be lifted.

While the non-washing mode is converted into the washing mode, the latch motor 73 operates and moves the latch 71. The latch 71 moves out of the latch casing 72 and moves to the internal coupling space 51. The latch 71 applies the external force to the pressurized portion 62 and the door coupling hook 61 moves in such a way that the holding portion 63 may be located in the door coupling groove 25 as shown in FIG. 24B.

In the washing mode, as shown in FIG. 24B, the outer door 20 and the inner door 50 are separated from each other. Due to an operation of the driving unit 100, the tub 30 moves backward and the inner door 50 may move together due to the latch 71. The outer door 20 and the inner door 50 are separated, thereby preventing the oscillation of the tub 30 from being transferred to the cabinet 10.

Figure 25A:
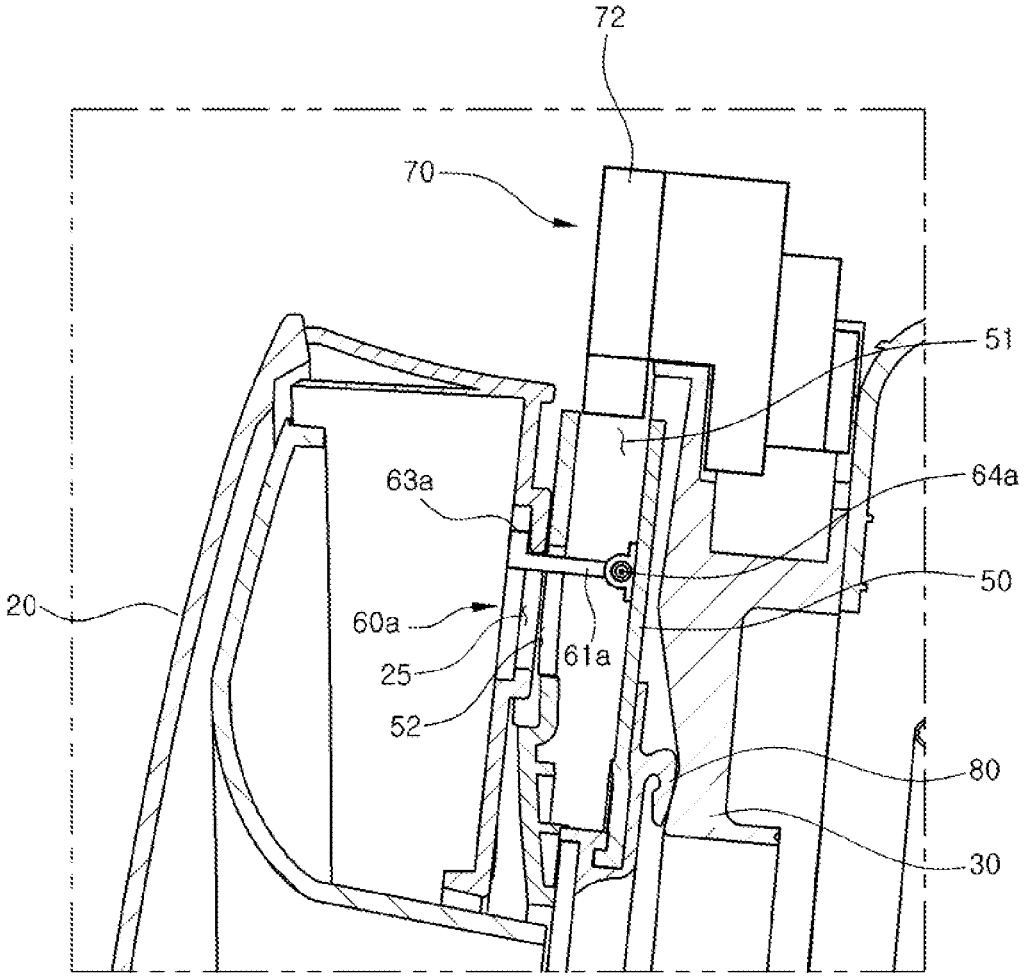
FIGS. 25A and, 25B are partial side cross-sectional views illustrating an operation of the washing machine according to another embodiment of the present disclosure.
Figure 25B:
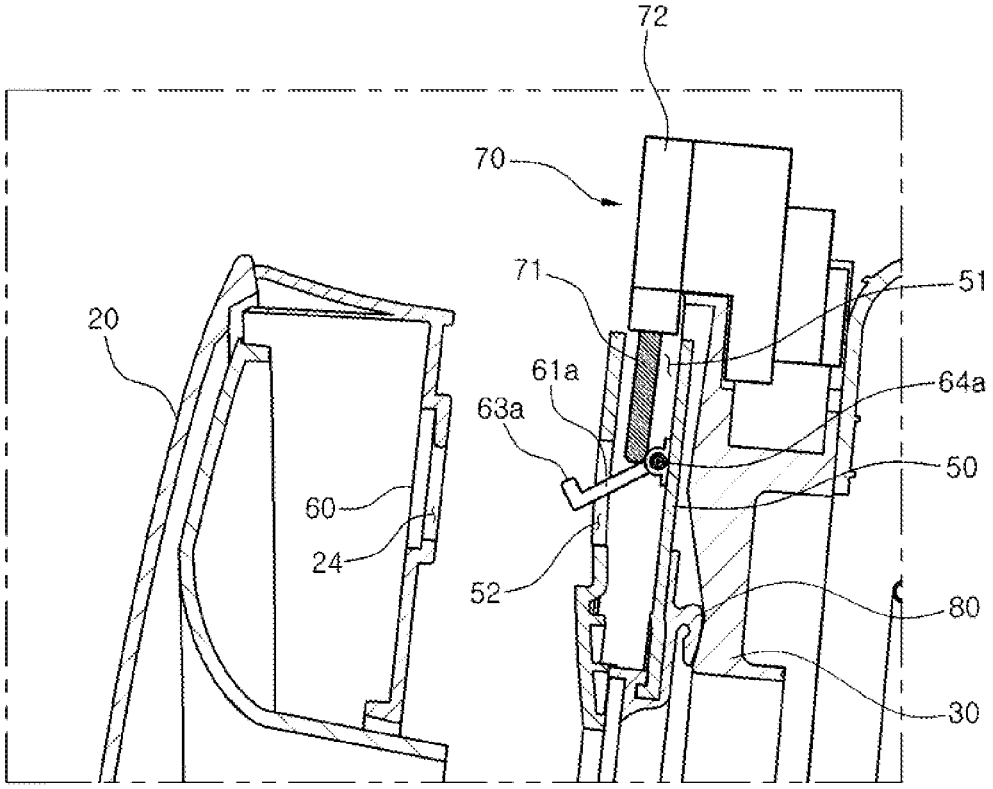

FIGS. 25A and, 25B are side cross-sectional views illustrating an operation of the washing machine 1 according to another embodiment of the present disclosure. FIGS. 25A and 25B illustrate another example of a first coupling member and the description with reference to FIGS. 25A and 25B will be referred to where applicable.

The first coupling member 60*a* may include a door coupling hook 61*a* which is pivotably provided. A hook spring 64*a* may be provided at one end of the door coupling hook 61*a*. As shown in FIG. 25*a*, in the washing mode, the door coupling hook 61*a* may be disposed to allow a holding portion 63*a* to be located in front of the rear surface of the outer door 20.

When the washing mode may be switched into the non-washing mode, the latch 71 may move and an external force may be applied to one side of the door coupling hook 61*a*. Due to the external force, the door coupling hook 61*a* may rotate and the hook spring 64*a* may be deformed. As the door coupling hook 61*a* rotates, the holding portion 63*a* may be located at the door coupling groove 25. Here, according to the movement of the tub 30 due to the driving unit 100, as shown in FIG. 25B, the inner door 50 and the outer door 20 may be separated.

When the non-washing mode is switched into the washing mode, the latch 71 may move again and the external force may be removed from the one side of the door coupling hook 61*a*. The door coupling hook 61*a* may rotate to an original position due to an elastic force of the hook spring 64*a*, and the outer door 20 and the inner door 50 may be coupled with each other.

Figure 26:
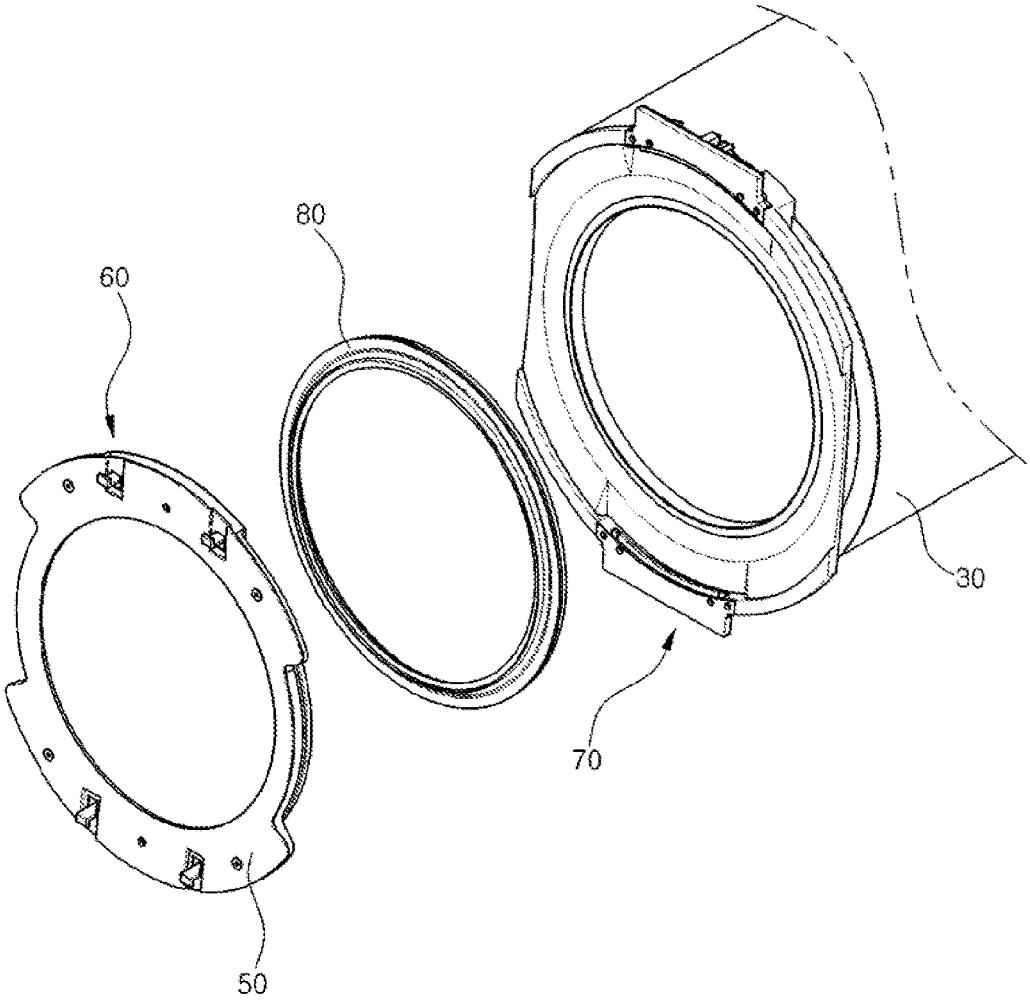
FIG. 26 is an exploded view of the inner door, a sealing member, and the tub of the washing machine according to one embodiment of the present disclosure.

FIG. 26 is an exploded view of the inner door 50, a sealing member 80, the second coupling member 70 and the tub 30 of the washing machine 1 according to one embodiment of the present disclosure.

As described above, the tub 30 is provided to store the washing water and the inner door 50 is disposed in front thereof. To prevent the leakage of the washing water, it is necessary to strongly couple the inner door 50 with the tub 30. Accordingly, between the inner door 50 and the tub 30, the sealing member 80 for preventing the leakage of the washing water may be provided.

The sealing member 80 may be provided as a ring shape whose center is open. Also, the sealing member 80 may be formed of a material having an elastic force such as rubber and may be partially deformed, thereby preventing the leakage of the washing water.

The sealing member 80 may be mounted on at least one of the inner door 50 and the tub 30. Hereinafter, an example in which the sealing member 80 is mounted on the inner door 50 will be described.

Figure 27:
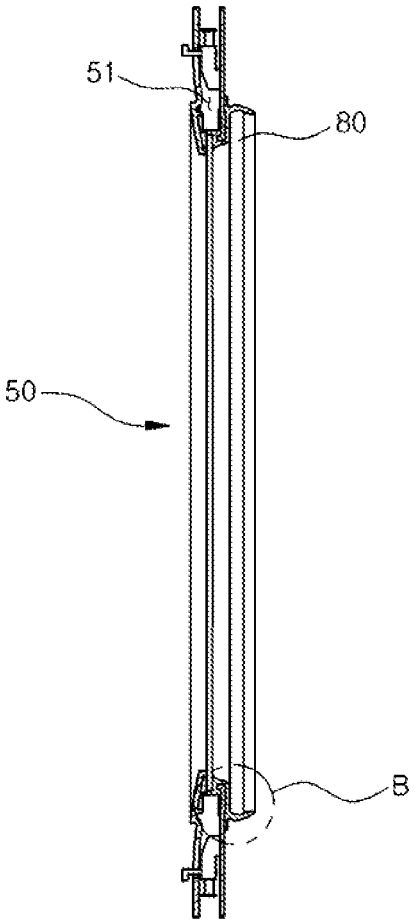
FIG. 27 is a side cross-sectional view illustrating coupling between the inner door and the sealing member of the washing machine according to one embodiment of the present disclosure.
Figure 28:
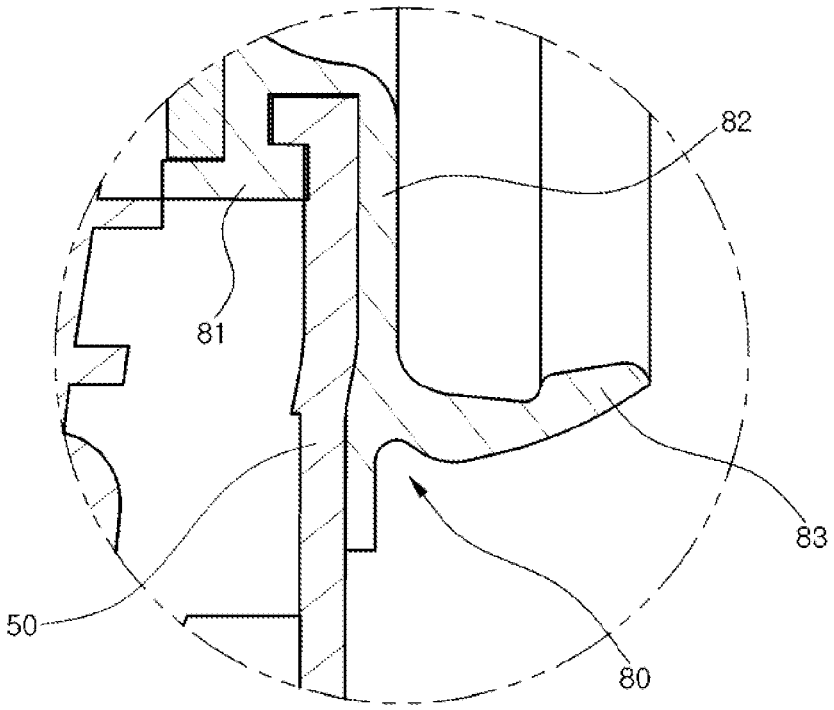
FIG. 28 is an enlarged view illustrating portion B of FIG. 27.

FIG. 27 is a side cross-sectional view illustrating coupling between the inner door 50 and the sealing member 80 of the washing machine 1 according to one embodiment of the present disclosure. FIG. 28 is an enlarged view illustrating portion B of FIG. 27.

As shown in FIG. 28, the sealing member 80 may include a sealing coupling portion 81 coupled with the inner door 50 and a sealing compressed portion 83 which extends toward the tub 30. Also, the sealing member 80 may include a sealing connecting portion 82 which connects the sealing coupling portion 81 and the sealing compressed portion 83 to be integrated.

The sealing coupling portion 81 may be fixed to the inner door 50. The sealing connecting portion 82 may extend along the inner door 50. The sealing compressed portion 83 may extend toward the tub 30, and an end of the sealing compressed portion 83 may be bent toward the center of the tub 30.

Figure 29:
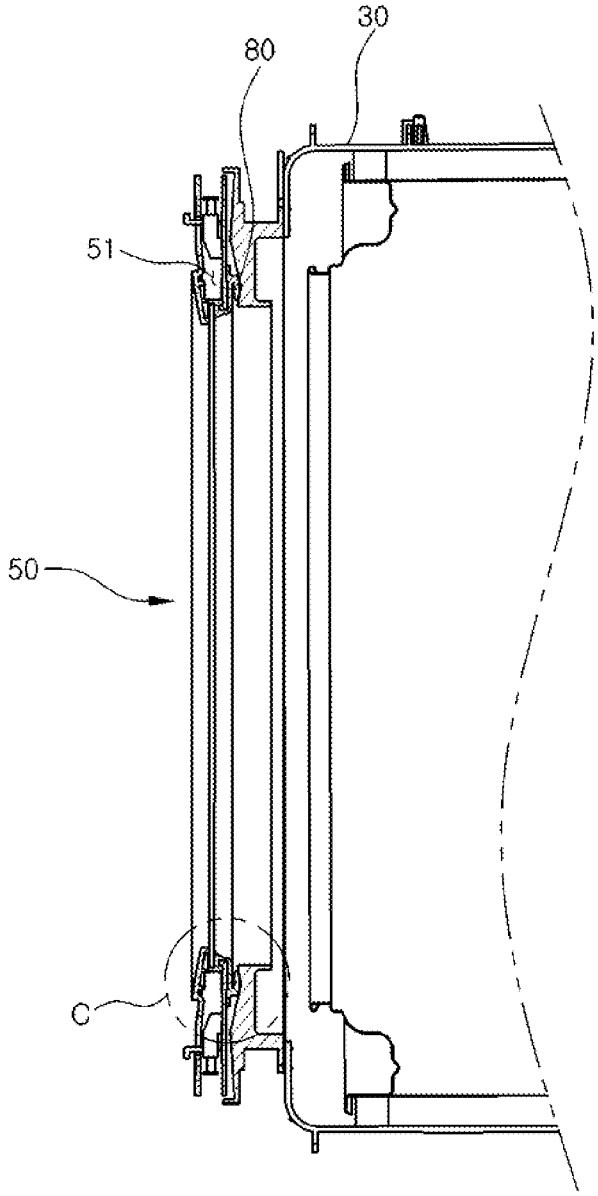
FIG. 29 is a partial side cross-sectional view illustrating coupling between the inner door, the sealing member, and the tub of the washing machine according to one embodiment of the present disclosure.
Figure 30:
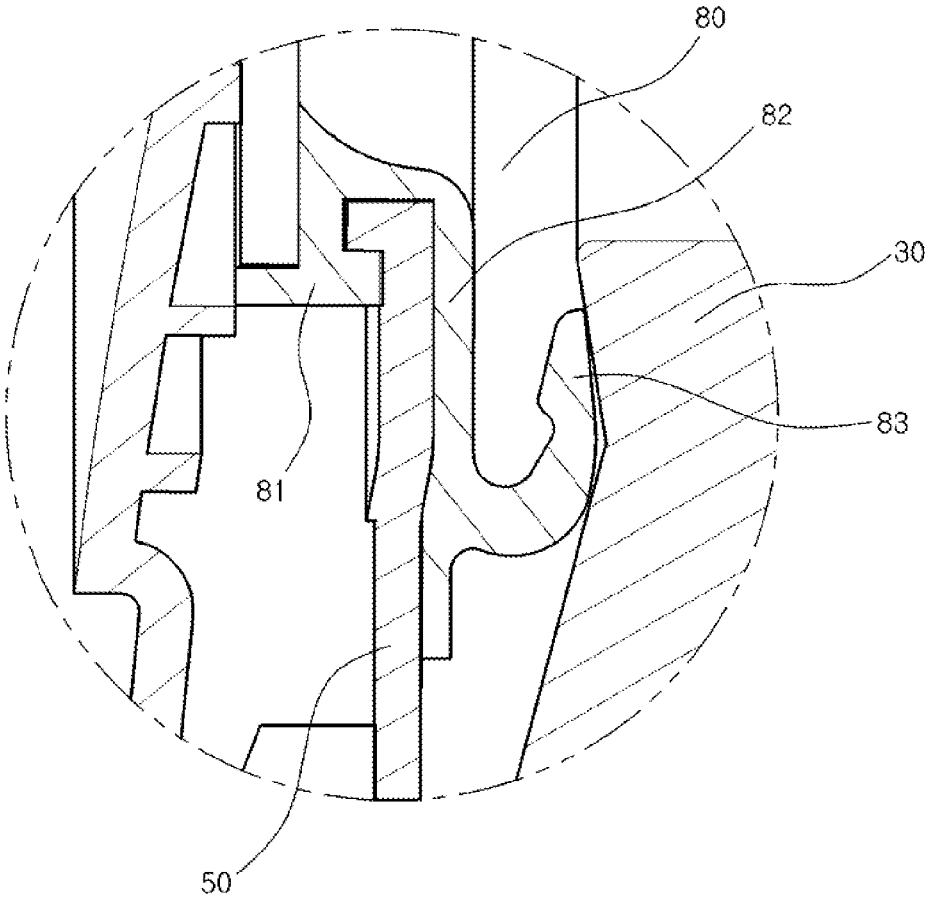
FIG. 30 is an enlarged view illustrating portion C of FIG. 29.

FIG. 29 is a partial side cross-sectional view illustrating coupling between the inner door 50, the sealing member 80, and the tub 30 of the washing machine 1 according to one embodiment of the present disclosure. FIG. 30 is an enlarged view illustrating portion C of FIG. 29.

When the inner door 50 is coupled with the tub 30, the sealing compressed portion 83 may be deformed. When the opening 12 is closed, the inner door 50 pivots toward the tub 30. Here, the end of the sealing compressed portion 83 which extends toward the tub 30 may be in contact with one side of the tub 30 and may be deformed.

The end of the sealing compressed portion 83 is provided to be shaped to bend toward the center of the tub 30. When the sealing compressed portion 83 is deformed, the sealing compressed portion 83 may bend toward the center of the tub 30. Due to the sealing member 80 bent toward the center of the tub 30, it is possible to prevent the leakage of the washing water inside the tub 30.

Hereinafter, the sealing member 80 described above will be referred to as a first sealing member 80. FIGS. 31 to 35 illustrate various examples of the sealing member. However, they are merely examples, and various sealing members which prevent the leakage of the washing water may be included. The description with reference to FIGS. 26 to 30 will be referred to where applicable.

Figure 31:
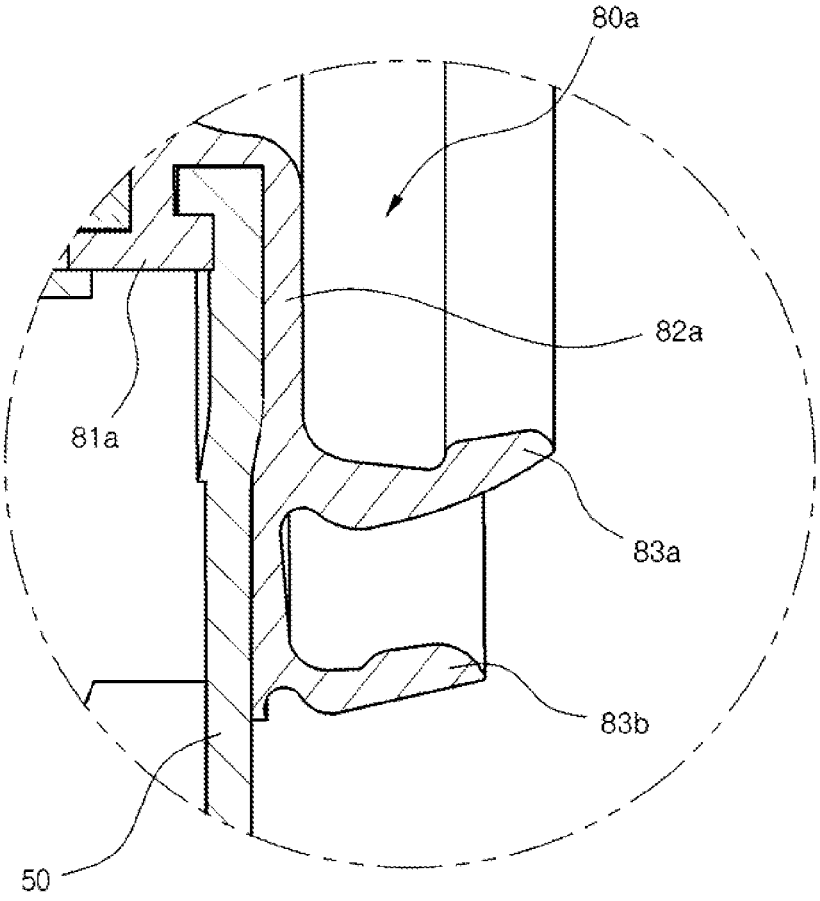
FIGS. 31 and 32 are cross-sectional views of a sealing member of the washing machine according to another embodiment of the present disclosure.
Figure 32:
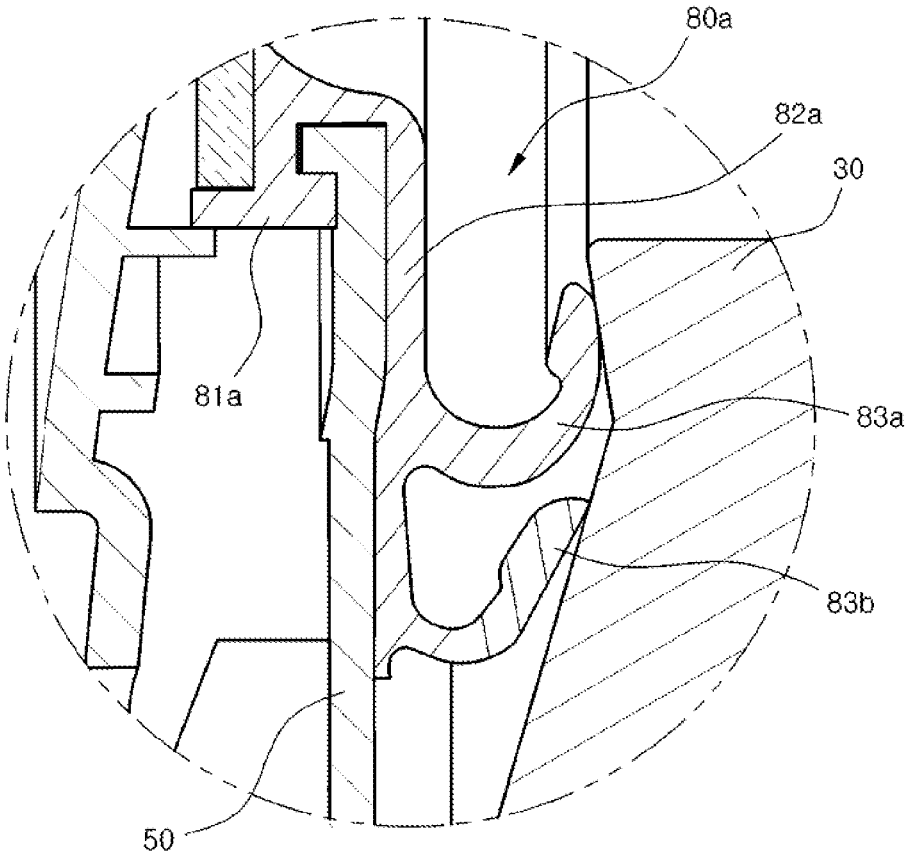

FIGS. 31 and 32 are cross-sectional views of a sealing member 80*a* of the washing machine 1 according to another embodiment of the present disclosure. FIG. 31 illustrates a state in which the inner door 50 and the tub 30 are separated from each other. FIG. 32 illustrates a state in which the inner door 50 and the tub 30 are coupled with each other. The sealing member shown in FIGS. 31 and 32 will be referred to as a second sealing member 80*a*.

The second sealing member 80*a* may include a plurality of sealing compressed portions 83*a* and 83*b*. A first sealing compressed portion 83*a* and a second sealing compressed portion 83*b* are shown in FIGS. 31 and 32, but the present disclosure is not limited thereto. The first sealing compressed portion 83*a* and the second sealing compressed portion 83*b* may extend toward the tub 30 and ends thereof may be bent toward the center of the tub 30.

The first sealing compressed portion 83*a* and the sealing compressed portion 83*b* are spaced apart, thereby double-preventing the leakage of the washing water. For coupling with the tub 30, the first sealing compressed portion 83*a* and the second sealing compressed portion 83*b* may have different sizes. As shown in FIG. 32, the leakage of the washing water may be preliminarily prevented by the first sealing compressed portion 83*a*. When the first sealing compressed portion 83*a* leaks the washing water, the leakage of the washing water may be secondarily prevented by the second sealing compressed portion 83*b*.

Figure 33:
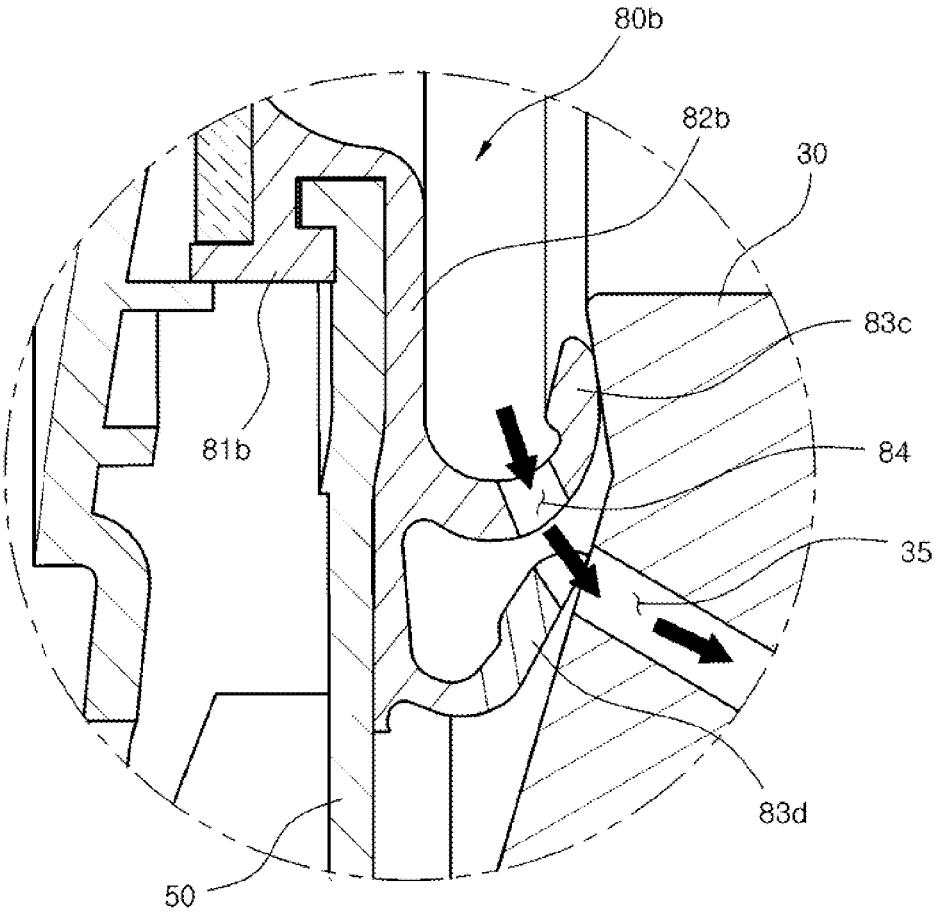
FIG. 33 is a cross-sectional view of a sealing member of the washing machine according to still another embodiment of the present disclosure.

FIG. 33 is a cross-sectional view of a sealing member 80*b* of the washing machine 1 according to still another embodiment of the present disclosure. FIG. 33 illustrates a state in which the inner door 50 and the tub 30 are coupled with each other. The sealing member shown in FIG. 33 will be referred to as a third sealing member 80*b*.

When an end is bent toward the center of the tub 30 like the first sealing member 80 and the second sealing member 80*a*, some of the washing water may remain in a bent portion. Due to the residual water described above, the user may feel uncomfortable while the opening 12 is open and mold may reproduce.

Accordingly, the third sealing member 80*b* may include a sealing drainage hole 84 for discharging the residual water. The residual water may be collected at a bottom of the third sealing member 80*b* due to gravity, and the sealing drainage hole 84 may be provided at least one at the bottom of the third sealing member 80*b*. The tub 30 may include a tub drainage hole 35 corresponding to the sealing drainage hole 84.

As shown in FIG. 33, the third sealing member 80*b* is in contact with the tub 30 to allow the sealing drainage hole 84 and the tub drainage hole 35 to be connected with each other. Here, the third sealing member 80*b* is shown as including a first sealing compressed portion 83*c* and a second sealing compressed portion 83*d*, but the present disclosure is not limited thereto, and may include one or three or more sealing compressed portions 83. The residual water in the third sealing member 80*b* may pass the sealing drainage hole 84 and the tub drainage hole 35 and may flow into the tub 30 to be drained (e.g., as the arrows in FIG. 33 illustrate).

Figure 34:
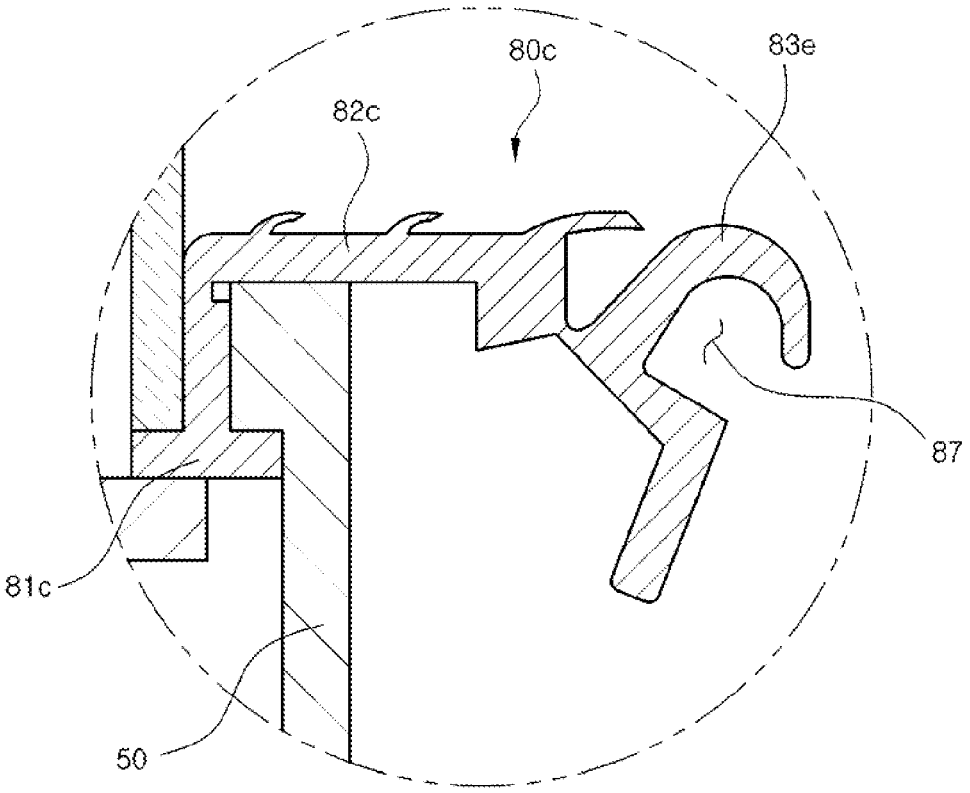
FIGS. 34 and 35 are cross-sectional views of a sealing member of the washing machine according to yet another embodiment of the present disclosure.
Figure 35:
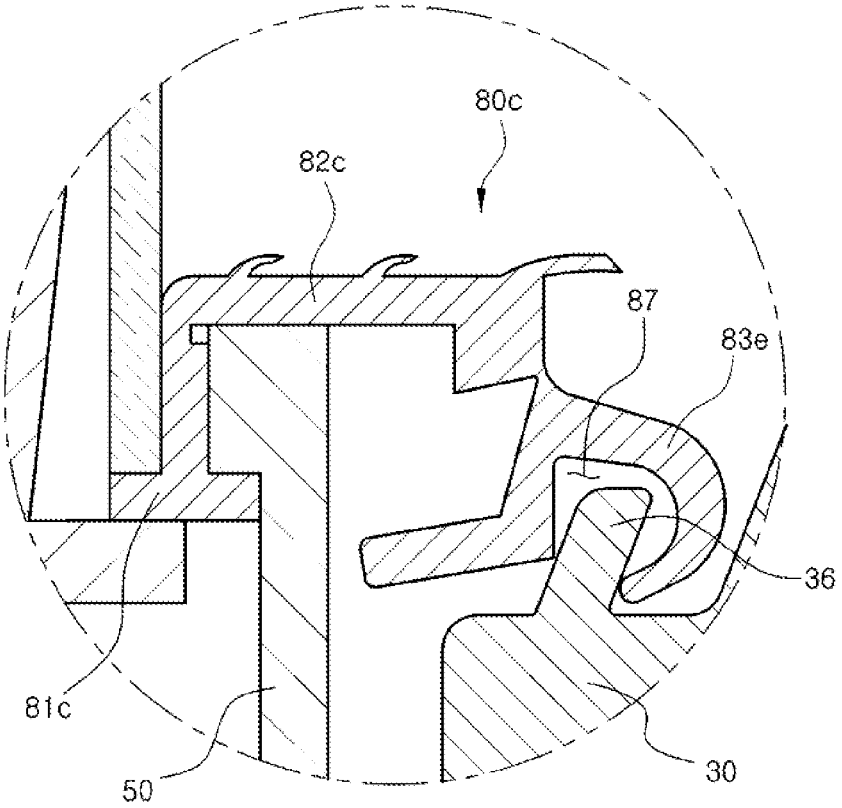

FIGS. 34 and 35 are cross-sectional views of a sealing member 80*c* of the washing machine 1 according to yet another embodiment of the present disclosure. FIG. 34 illustrates a state in which the inner door 50 and the tub 30 are separated from each other. FIG. 35 illustrates a state in which the inner door 50 and the tub 30 are coupled with each other. The sealing member 80 shown in FIGS. 34 and 35 will be referred to as a fourth sealing member 80*c*.

The fourth sealing member 80*c* may include a sealing coupling portion 81*c*, a sealing connecting portion 82*c*, and a sealing compressed portion 83*e*. The sealing coupling portion 81*c* may be fixed to the inner door 50, and the sealing connecting portion 82*c* may extend along the inner door 50. The sealing compressed portion 83*e* may be provided to face the tub 30 and may be pivotably connected to the sealing connecting portion 82*c*. Also, the sealing compressed portion 83*e* may include a sealing mounting space 87.

As shown in FIG. 35, the tub 30 may include a sealing protrusion 36 corresponding to the sealing mounting space 87. The sealing compressed portion 83*e* may be disposed surrounding the sealing protrusion 36 to allow the sealing protrusion 36 to be located in the sealing mounting space 87.

As shown in FIGS. 34 and 35, the sealing compressed portion 83*e* may pivot at a certain angle and may surround the sealing protrusion 36. Due to the sealing compressed portion 83*e* disposed to surround the sealing protrusion 36, it is possible to prevent the tub 30 from leaking the washing water.

Figure 36:
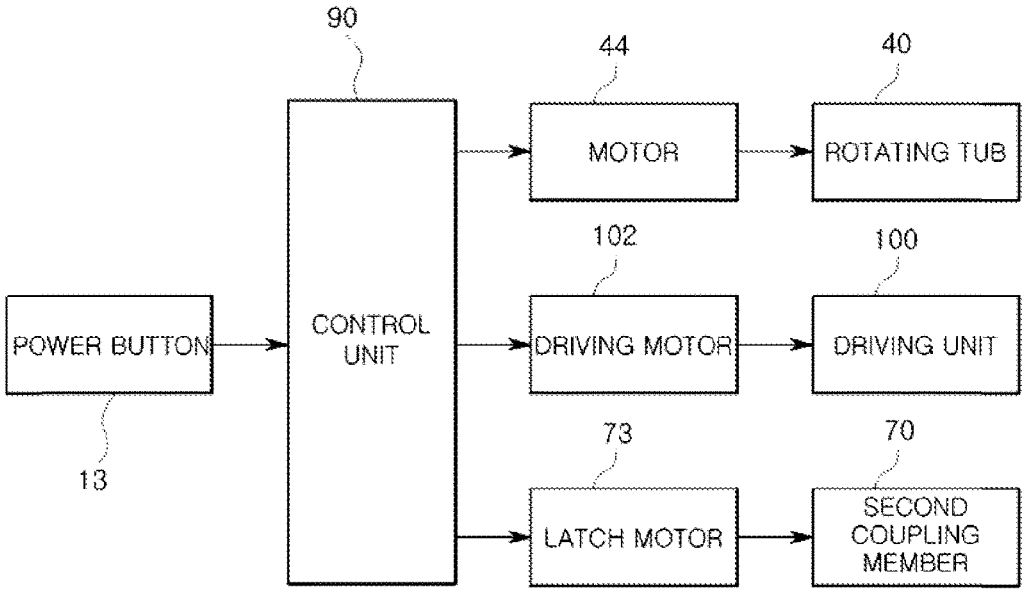
FIG. 36 is a view illustrating a control flow of the washing machine according to one embodiment of the present disclosure.

FIG. 36 is a view illustrating a control flow of the washing machine 1 according to one embodiment of the present disclosure. As described above, the washing machine 1 may include the power button 13, the motor 44, the drum 40, the driving motor 102, the driving unit 100, the latch motor 73, and the second coupling member 70. Also, the washing machine 1 may include a control unit 90 which controls the operation of the washing machine 1.

According to a signal input to the power button 13, the control unit 90 may drive the motor 44, the driving motor 102, and the latch motor 73. Also, the control unit 90 may control rotational directions and speeds of the respective motors 44, 102, and 73.

As described above, the motor 44 may perform the washing operation and the dehydrating operation by operating the drum 40. Also, the driving motor 102 may move the tub 30 by operating the driving unit 100. Also, the latch motor 73 may operate in such a way that the tub 30 and the inner door 50 may be coupled with or separated from each other. The first coupling member 60 is interlocked and operated by the second coupling member 70, thereby coupling or separating the inner door 50 with or from the outer door 20.

Figure 37A:
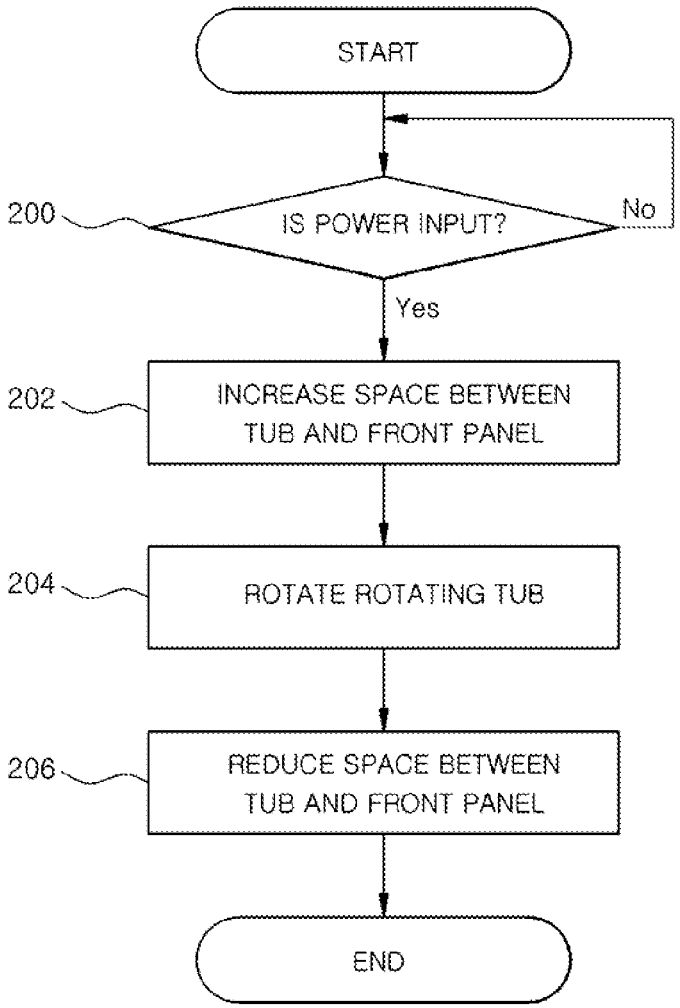
FIGS. 37A, 37B, and 37C are flowcharts illustrating a method of controlling the washing machine according to one embodiment of the present disclosure.

FIG. 37A is a flowchart illustrating a method of controlling the washing machine 1 according to one embodiment of the present disclosure. Particularly, the mobile mechanism of the washing machine 1 will be described.

When the power of the washing machine 1 is input (S200), the space between the tub 30 and the front panel 11 increases (S202). That is, the inner surface of the cabinet 10 becomes farther from the tub 30 and the drum 40 disposed inside the tub 30. Here, the tub 30 may move to become farther from the front panel 11 or the front panel 11 may move to become farther from the tub 30. Also, the tub 30 and the front panel 11 may move respectively to become farther from each other.

After that, the drum 40 may rotate to perform washing of the laundry due to the signal of the control unit 90 (S204), and the tub 30 may oscillate due to the rotation of the drum 40. Due to the front panel 11 and the tub 30 separated from each other, it is possible to prevent the oscillation of the tub 30 from being transferred to the cabinet 10.

When the rotation of the drum 40 stops and the washing is completed, the space between the tub 30 and the front panel 11 is reduced (S206). Here, at least one of the tub 30 and the front panel 11 may be moved. The control is completed while the front panel 11 and the tub 30 are being close to each other.

Figure 37B:
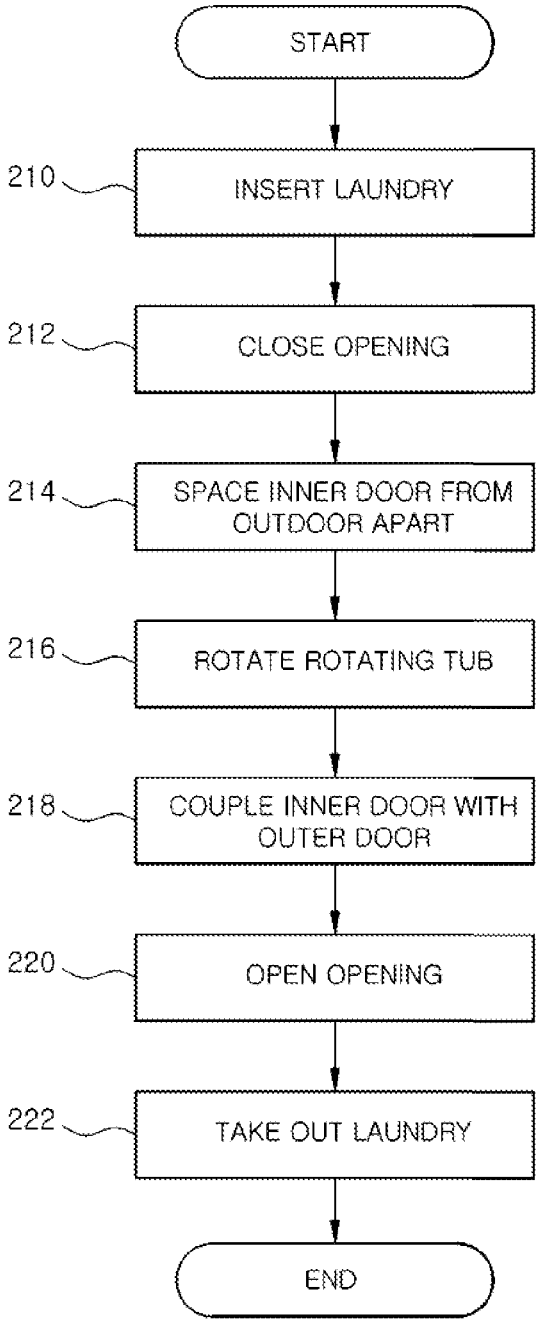

FIG. 37B is a flowchart illustrating a method of controlling the washing machine 1 according to one embodiment of the present disclosure. Particularly, a washing process of the user using the washing machine 1 will be described.

The user inserts the laundry which needs washing into the washing machine 1 through the opening 12 (S210). In detail, the laundry is mounted in the drum 40 provided inside the tub 30.

After inserting the laundry, the user pivots the outer door 20 and inner door 50 to close the opening 12 (S212). Here, the inner door 50 and the outer door 20 are coupled with each other in such a way that the user may close the opening 12 through pivoting once. The user inputs the power of the washing machine 1 by pushing the power button 13 and inserts a necessary detergent into the detergent box 16. Also, a preferable washing mode may be selected by operating the operation unit 14.

When the washing starts, coupling between the inner door 50 and the outer door 20 is released and then the inner door 50 and the tub 30 are fixed. The inner door 50 coupled with the tub 30 is spaced from the outer door 20 (S214). Here, the tub 30 and the inner door 50 may move or the outer door 20 may move. Also, the tub 30, the inner door 50, and the outer door 20 may move respectively to be separated from one another.

After that, the drum 40 may rotate due to the signal of the control unit 90 (S216), and the tub 30 and the inner door 50 may oscillate due to the rotation of the drum 40. Due to the inner door 50 and the outer door 20 spaced from each other, it is possible to prevent the oscillation of the inner door 50 from being transferred to the cabinet 10 in which the outer door 20 is installed.

When the rotation of the drum 40 stops and the washing is completed, the inner door 50 and the outer door 20 are connected to each other. Fixation and coupling between the tub 30 and the inner door 50 are released, and the inner door 50 and the outer door 20 are coupled with each other (S218).

The user pivots the inner door 50 and the outer door 20 coupled with each other to open the opening 12 (S220). The laundry whose washing is completed may be taken out of the washing machine 1 through the opening 12 which is open (S222).

Figure 37C:
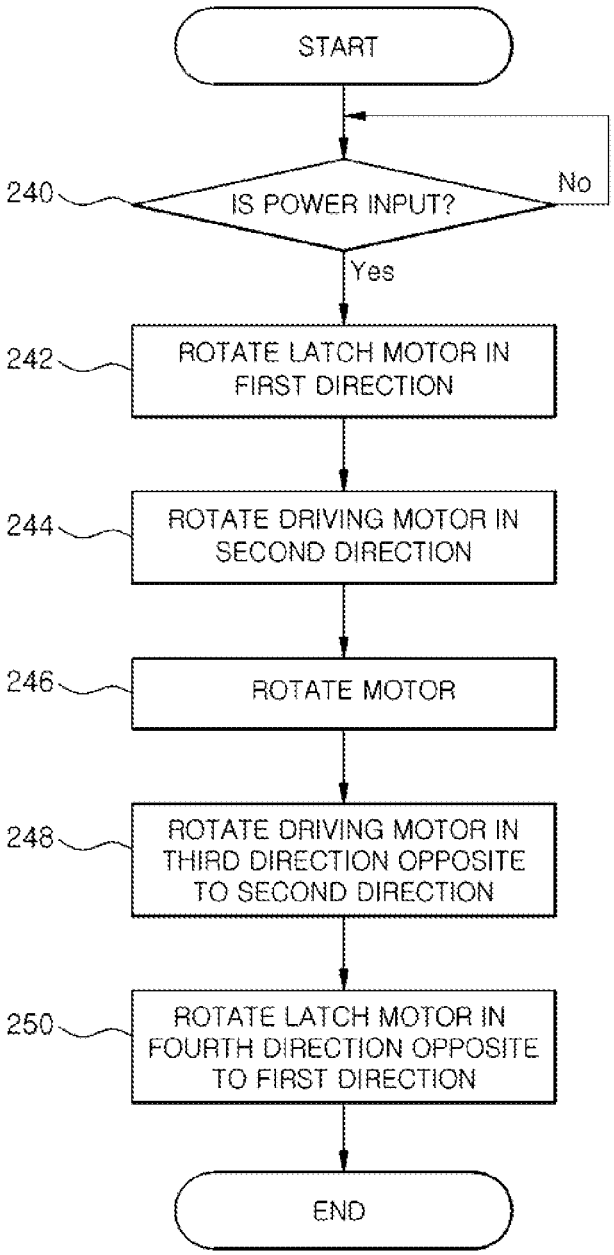

FIG. 37C is a flowchart illustrating a method of controlling the washing machine 1 according to one embodiment of the present disclosure. Particularly, operations of components of the washing machine 1 using various motors will be described.

When the power of the washing machine 1 is input (S240), the control unit 90 transmits a signal to rotate the latch motor 73 in a first direction. The latch motor 73 rotates in the first direction (S242), and accordingly, the latch 71 of the second coupling member 70 moves. Here, the latch 71 may move to couple the inner door 50 with the tub 30, and the door coupling hook 61 of the first coupling member 60 may move due to the latch 71 to release the coupling between the inner door 50 and the outer door 20.

After that, the control unit 90 transmits a signal to rotate the driving motor 102 in a second direction. The driving motor 102 rotates in the second direction (S244), and accordingly, the moving portion 110 of the driving unit 100 moves. The moving portion 110 may move at least one of the front panel 11 and the tub 30 to allow the front panel 11 and the tub 30 to be spaced from each other.

After that, the control unit 90 transmits a signal to rotate the motor 44. The motor 44 rotates to perform the washing operation and the dehydrating operation (S246), and accordingly, the drum 40 rotates to wash the laundry.

When the washing is completed, the control unit 90 transmits a signal to rotate the driving motor 102 in a third direction. The driving motor 102 rotates in the third direction opposite to the second direction (S248), and accordingly, the moving portion 110 moves. The moving portion 110 may move at least one of the front panel 11 and the tub 30 to allow the front panel 11 and the tub 30 to be connected to each other.

After that, the control unit 90 transmits a signal to rotate the latch motor 73 in a fourth direction. The latch motor 73 rotates in the fourth direction opposite to the first direction (S250), and accordingly, the latch 71 moves. Here, the latch 71 may move to release the coupling between the inner door 50 and the tub 30, and the door coupling hook 61 may move to couple the inner door 50 with the outer door 20.

As is apparent from the above description, it is possible to prevent oscillation from being transferred by spacing a front panel and a tub apart during washing. Also, it is possible to provide convenience for a user by arranging the front panel and the tub adjacent to each other while inserting or taking out laundry. It is possible to prevent a water leakage of the tub and to allow a user to conveniently open and close an opening by providing an inner door which is selectively coupled with a tub and an outer door.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a tub disposed inside the cabinet;

a drum rotatably provided inside the tub;

a front panel which is located at one side of the cabinet and comprises an opening through which laundry is inserted and taken out;

a driver which moves the tub in a direction toward the front panel to reduce a pap between the tub and the front panel; and a controller configured to control the driver to move the tub to reduce the gap between the tub and the front panel for a non-washing mode, and move the tub to increase the gap between the tub and the front panel for a washing mode.

2. The washing machine of claim 1, wherein the driver is installed in the cabinet to move the tub.

3. The washing machine of claim 2, wherein, when the laundry is inserted into or taken out of the drum, the driver arranges the front panel and the tub to be in contact with each other.

4. The washing machine of claim 2, wherein, when the drum rotates, the driver arranges the front panel and the tub to be separated from each other.

5. The washing machine of claim 1, further comprising:

an outer door provided at the front panel to open and close the opening; and an inner door provided at the tub to prevent a water leakage of the tub.

6. The washing machine of claim 5, wherein the inner door is provided to be attachable to and detachable from the outer door.

7. The washing machine of claim 5, wherein the inner door is coupled with the outer door when the laundry is inserted into or taken out of the drum, and wherein the inner door is coupled with the tub when the drum rotates.

8. The washing machine of claim 7, wherein at least one of the inner door and the outer door comprises a first coupling member to couple the inner door with the outer door, wherein at least one of the inner door and the tub comprises a second coupling member to couple the inner door with the tub, and wherein the first coupling member and the second coupling member are disposed to be interlocked with each other.

9. The washing machine of claim 5, wherein the inner door is selectively coupled with one of the tub and the outer door.

10. The washing machine of claim 1, wherein the driver moves the tub in at least one of front, rear, upper, and lower directions.

11. The washing machine of claim 10, wherein the driver moves the tub to a front upper portion of the cabinet to reduce the gap between the tub and the front panel, and wherein the driver moves the tub to a rear lower portion of the cabinet to increase the gap between the tub and the front panel.

12. The washing machine of claim 2, wherein the driver comprises a fixed portion fixed to one side of the cabinet and a moving portion movably provided at the fixed portion.

13. The washing machine of claim 12, wherein the moving portion comprises a moving contact surface in contact with the tub, and wherein the moving contact surface is formed as an inclined plane.

14. The washing machine of claim 13, wherein the tub comprises a tub contact surface formed as an inclined plane to correspond to the moving contact surface, and wherein the tub contact surface and the moving contact surface are in contact with each other and move the tub.

15. The washing machine of claim 2, wherein the driver is installed to connect the tub with the cabinet, and wherein a length of the driver is changeable.

16. A washing machine comprising:

a cabinet;

an outer door provided at one side of the cabinet to open and close an opening;

a tub disposed inside the cabinet to be movable forward and backward; and an inner door provided at one side of the tub to prevent a water leakage of the tub, the inner door being attachable to and detachable from the outer door.

17. The washing machine of claim 16, wherein the inner door is selectively coupled with one of the outer door and the tub.

18. The washing machine of claim 17, further comprising:

a first coupling member provided to couple the inner door with the outer door; and a second coupling member provided to couple the inner door with the tub.

19. The washing machine of claim 16, further comprising a driver which moves at least one of the inner door and the outer door.

20. The washing machine of claim 16, wherein the outer door is pivotably installed at the one side of the cabinet, and wherein the inner door and the outer door are coupled with each other to be pivotable together.

* * * * *